US010915036B2

(12) United States Patent
Ogawa et al.

(10) Patent No.: US 10,915,036 B2
(45) Date of Patent: Feb. 9, 2021

(54) IMAGE FORMING APPARATUS AND METHOD OF CONTROLLING SAME

(71) Applicant: CANON KABUSHIKI KAISHA, Tokyo (JP)

(72) Inventors: Hiroaki Ogawa, Kawasaki (JP); Takeru Sasaki, Kawasaki (JP); Takashi Fujita, Kawasaki (JP); Okinori Tsuchiya, Yokohama (JP); Akitoshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/429,535

(22) Filed: Jun. 3, 2019

(65) Prior Publication Data

US 2019/0377277 A1 Dec. 12, 2019

(30) Foreign Application Priority Data

Jun. 12, 2018 (JP) ..... 2018-112219

(51) Int. Cl.
*G03G 15/01* (2006.01)
*G03G 15/00* (2006.01)

(52) U.S. Cl.
CPC ..... *G03G 15/0121* (2013.01); *G03G 15/50* (2013.01)

(58) Field of Classification Search
CPC ..... G03G 15/50; G03G 15/0121
See application file for complete search history.

(56) References Cited

U.S. PATENT DOCUMENTS

| | | | | |
|---|---|---|---|---|
| 5,699,100 | A | 12/1997 | Fukuda et al. | |
| 6,801,233 | B2 | 10/2004 | Bhatt et al. | |
| 8,372,782 | B2 | 2/2013 | Vetterling et al. | |
| 2003/0125206 | A1 | 7/2003 | Bhatt et al. | |
| 2011/0012979 | A1 | 1/2011 | Kitamura | |
| 2012/0050365 | A1* | 3/2012 | Konno | B41J 29/38 347/14 |

FOREIGN PATENT DOCUMENTS

| | | | |
|---|---|---|---|
| CN | 1403295 | A | 3/2003 |
| CN | 1537059 | A | 10/2004 |
| CN | 101495319 | A | 7/2009 |

(Continued)

OTHER PUBLICATIONS

Search Report dated Oct. 29, 2019, in European Application No. 19177746.5.

(Continued)

*Primary Examiner* — Lamson D Nguyen
(74) *Attorney, Agent, or Firm* — Venable LLP

(57) ABSTRACT

An image forming apparatus comprises a printhead configured to add energy to an image material including a plurality of color development layers that have different color development characteristics and develop colors in response to heat; and a control unit configured to output, based on image data, signal patterns corresponding to the plurality of color development layers and at least one signal pattern corresponding to a color reproduced by causing at least two of the plurality of color development layers to develop colors used to control the energy to be added to the image material by the printhead.

25 Claims, 17 Drawing Sheets

(56) References Cited

FOREIGN PATENT DOCUMENTS

| | | | |
|---|---|---|---|
| CN | 101977775 | A | 2/2011 |
| CN | 102369111 | A | 3/2012 |
| CN | 102381024 | A | 3/2012 |
| JP | S52-130336 | A | 11/1977 |
| JP | H08-072414 | A | 3/1996 |
| JP | H10-034984 | A | 2/1998 |
| JP | 4677431 | B | 4/2011 |
| JP | 2013-506582 | A | 2/2013 |
| WO | 2011/044049 | A | 4/2011 |

OTHER PUBLICATIONS

U.S. Appl. No. 16/503,809, filed Jul. 5, 2019 (First named inventor: Takashi Fujita).
U.S. Appl. No. 16/458,604, filed Jul. 1, 2019 (First named inventor: Okinori Tsuchiya).
Office Action, dated Dec. 1, 2020, in Chinese Patent Application No. 201910501849.X.

* cited by examiner

IMAGE FORMING APPARATUS AND METHOD OF CONTROLLING SAME

BACKGROUND OF THE INVENTION

Field of the Invention

The present invention relates to an image forming apparatus and a method of controlling the same.

Description of the Related Art

Conventionally, monochrome printing using thermosensible paper, color printing using an ink ribbon, and the like are known concerning a thermal printer. Additionally, in recent years, color image formation using a sheet including a plurality of color development layers corresponding to a plurality of colors has been provided to the market and become popular as a printing means for a photo or the like.

The plurality of color development layers provided on the sheet have different color development characteristics and develop colors in accordance with given energy (heating temperature and heating time). For example, In Japanese Patent Laid-Open No. 2013-506582 or Japanese Patent No. 4677431, a color image is formed by causing a specific color development layer to develop a color using the difference between the color development characteristics of the color development layers.

However, in the conventional method, energies for color development are individually added to cause the color development layers to develop colors in order. Hence, there are restrictions for color development, and the reproducibility of a color reproduced by combining a plurality of color development layers is not sufficient.

SUMMARY OF THE INVENTION

According to one aspect of the present invention, there is provided an image forming apparatus comprising: a printhead configured to add energy to an image material including a plurality of color development layers that have different color development characteristics and develop colors in response to heat; and a control unit configured to output, based on image data, signal patterns corresponding to the plurality of color development layers and at least one signal pattern corresponding to a color reproduced by causing at least two of the plurality of color development layers to develop colors used to control the energy to be added to the image material by the printhead.

According to another aspect of the present invention, there is provided an image forming apparatus: a printhead configured to add the energy to an image material including N color development layers that have different color development characteristics and develop colors in accordance with added energy; and a control unit configured to convert pixel values of image data into M (>N) values corresponding to a color that can be reproduced by causing one or a plurality color development layers of the N color development layers to develop colors, and outputs a signal pattern that has a pulse width and the number of pulses corresponding to the converted value and is used to control the energy to be added to the image material by the printhead.

According to another aspect of the present invention, there is provided an image forming apparatus comprising: a printhead configured to add energy to an image material including a plurality of color development layers that have different color development characteristics and develop colors in response to heat; a control unit configured to output, based on image data, a signal pattern used to control the energy to be added to the image material by the printhead; a detection unit configured to detect a temperature of the image material; and a setting unit configured to set a predetermined threshold based on the image data, and wherein the control unit causes the image formation by the printhead to wait in a case in which it is determined that the temperature detected by the detection unit exceeds the predetermined threshold.

According to another aspect of the present invention, there is provided a method controlling of an image forming apparatus, the method comprising: outputting, based on image data, a signal pattern used to control the energy to be added to the image material by a printhead for adding the energy to an image material including a plurality of color development layers that have different color development characteristics and develop colors in accordance with added energy, using a plurality of signal patterns corresponding to the plurality of color development layers and at least one signal pattern corresponding to a color reproduced by causing at least two of the plurality of color development layers to develop colors.

According to the present invention, it is possible to improve the reproducibility of a color reproduced by combining a plurality of color development layers.

Further features of the present invention will become apparent from the following description of exemplary embodiments (with reference to the attached drawings).

DESCRIPTION OF THE EMBODIMENTS

An embodiment of the present invention will now be described in detail with reference to the accompanying drawings. It should be noted that arrangements and the like to be described below are merely examples and are not intended to limit the scope of the present invention.

First Embodiment

[Image Material]

Figure 1:
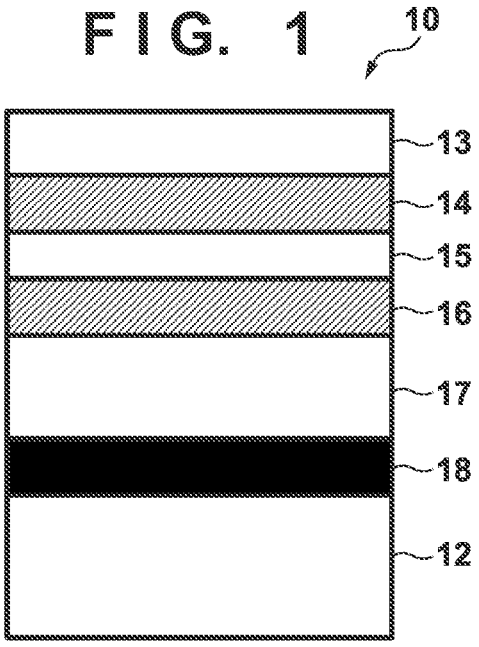
FIG. 1 is a view for explaining an image material according to the embodiment.

FIG. 1 is a conceptual view for explaining the structure of an image material according to this embodiment. In this embodiment, a description will be made using an infrared imaging method using infrared radiation as the heat source of an image forming apparatus. However, another method or heat source may be used.

Referring to FIG. 1, in an image material 10, a base material 12 that reflects light, an image forming layer 18, a spacer layer 17, an image forming layer 16, a spacer layer 15, an image forming layer 14, and a protective film layer 13 are formed sequentially from the lowermost layer. In general, the image forming layers 14, 16, and 18 are yellow, magenta, and cyan, respectively, in full color printing. However, a combination of other colors is also possible. That is, in the example shown in FIG. 1, image forming layers (color development layers) corresponding to three colors are provided. However, more image forming layers may be provided.

Each image forming layer is colorless at first (before image formation), and changes to a corresponding color when it is heated to a specific temperature called the activation temperature of the image forming layer. In this embodiment, the color development characteristics for color development in the image forming layers are different. The order (layering order) of the colors of the image forming layers in the image material 10 can arbitrarily be selected. One suitable color order is as described above. As another suitable order, the three image forming layers 14, 16, and 18 are cyan, magenta, and yellow, respectively. In this embodiment, an explanation will be made using an example in which the colors are arranged in the above-described order of yellow, magenta, and cyan. Note that in FIG. 1, the image forming layers are layered in the same thickness. However, the present invention is not limited to this, and the thickness may be changed in accordance with the color (color material).

Additionally, as shown in FIG. 1, spacer layers are provided between the image forming layers. The thickness of each spacer layer may be defined in accordance with the color development characteristic of each image forming layer, the heat conduction characteristic or thermal diffusivity of each layer, and the like. For example, the spacer layers may be made of the same material or different materials. The function of the spacer layers is control of thermal diffusion in the image material 10. Suitably, if the spacer layer 17 is made of the same material as the spacer layer 15, the spacer layer 17 is preferably at least four times thicker.

All the layers arranged on the base material 12 are substantially transparent before image formation. If the base material 12 has a reflective color (for example, white), a color image formed by the image material 10 is visually recognized through the protective film layer 13 against the reflective background provided by the base material 12. Since the layers layered on the base material 12 are transparent, a human can visually recognize the combinations of colors printed on the image forming layers.

The three image forming layers 14, 16, and 18 in the image material 10 according to this embodiment are arranged on the same side of the base material 12. However, some image forming layers may be arranged on the opposite side of the base material 12.

In this embodiment, the image forming layers 14, 16, and 18 are at least partially independently processed based on changes in two parameters adjustable in the image forming apparatus, that is, a temperature and time. As for these parameters, the time and the temperature of the printhead when applying heat to the image material 10 are controlled, thereby forming an image on a desired image forming layer. That is, when the time and the temperature added to the image material 10 are controlled, a desired image forming layer can be caused to develop a color of a desired density.

In this embodiment, each of the image forming layers 14, 16, and 18 is processed when the printhead applies heat while contacting the uppermost layer of the image material 10, that is, the protective film layer 13 shown in FIG. 1. The color development characteristic of each image forming layer according to this embodiment will be described. Let Ta3, Ta2, and Ta1 be the activation temperatures of the image forming layers 14, 16, and 18, respectively. In this case, the activation temperature (Ta3) of the image forming layer 14 is higher than the activation temperature (Ta2) of the image forming layer 16, and is also higher than the activation temperature (Ta1) of the image forming layer 18. The relationship between the activation (color development characteristics) of the image forming layers will be described later with reference to FIG. 2.

Heating of the image forming layers located at longer distances from the printhead (that is, the protective film layer 13) delays by the time necessary for heating because the heat is conducted and diffused to the layers through the spacer layers. Hence, even if the temperature added from the printhead to the surface (that is, the protective film layer 13) of the image material 10 is substantially higher than the activation temperature of the image forming layer located at a lower position (the layer located far apart from the printhead), control can be performed not to activate the image forming layer on the lower side while heating up to the activation temperature for the image forming layer closer to the printhead because of the delay of heating caused by heat diffusion by the layers. For this reason, when processing (developing the color) only the image forming layer 14 closest to the protective film layer 13, the printhead is heated up to a relatively high temperature (Ta3 or more) in a short time. In this case, insufficient heating is performed for both of the image forming layers 16 and 18, and color development (activation) of these is not performed.

When activating only the image forming layer (in this case, the image forming layer 16 or 18) close to the base material 12, the image forming layer is heated for a sufficiently long period at a temperature lower than the activation temperature of the image forming layer (for example, the image forming layer 14) farther apart from the base material 12. In this way, when the lower image forming layer (image forming layer 16 or 18) is activated, the higher image forming layer (for example, the image forming layer 14) is not activated.

As described above, heating of the image material 10 is preferably performed using a thermal printhead. However, another method may be used. For example, any known means such as a modulated light source (a means such as a laser) may be used.

[Color Development Characteristic]

Figure 2:
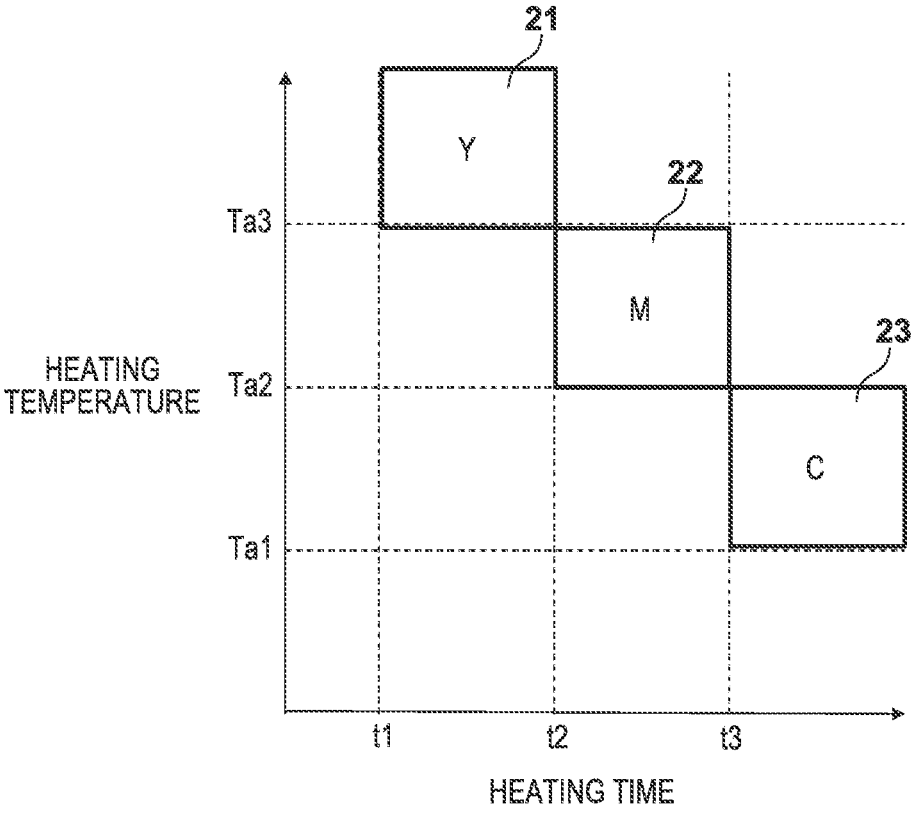
FIG. 2 is a view for explaining activation of image forming layers.

FIG. 2 is a view for explaining the relationship between heating temperatures and heating times necessary for processing the image forming layers 14, 16, and 18, which form the image material 10. Referring to FIG. 2, the ordinate represents a heating temperature on the surface of the image material 10 that comes into contact with the printhead, and the abscissa represents heating time. A description will be made here assuming that the heating temperature is the same as the temperature supplied by the printhead.

A region 21 represents a relatively high heating temperature and a relatively short heating time. In this embodiment, the region 21 corresponds to yellow of the image forming layer 14. That is, in the image forming layer 14, color development (image formation) is performed when the energy represented by the region 21 is supplied. A region 22 represents an intermediate heating temperature and an intermediate heating time. The region 22 corresponds to magenta of the image forming layer 16. That is, in the image forming layer 16, color development (image formation) is performed when the energy represented by the region 22 is supplied. A region 23 represents a relatively low heating temperature and a relatively long heating time. The region 23 corresponds to cyan of the image forming layer 18. That is, in the image forming layer 18, color development (image formation) is performed when the energy represented by the region 23 is supplied. The time necessary for imaging (color development) of the image forming layer 18 is substantially longer than the time necessary for imaging of the image forming layer 14.

As the activation temperature selected for an image forming layer, for example, a temperature within the range of about 90° C. to about 300° C. is used. For the thermal stability of the image material 10, the activation temperature (Ta1) of the image forming layer 18 is preferably constantly low as much as possible during shipment and storage, and is suitably about 100° C. or more. The activation temperature (Ta3) of the image forming layer 14, through which the image forming layers 16 and 18 are heated and activated, is preferably constantly high, and is suitably about 200° C. or more. The activation temperature (Ta2) of the image forming layer 16 is a temperature between Ta1 and Ta3, and is suitably about 140° C. to about 180° C.

Note that in each image forming layer, even if the energy in the corresponding region is added, the density of the formed color changes depending on the position in the region. For example, in a case in which the energy in the region 22 is given to the image forming layer 16, even if the heating time is the same, an image of a high density is formed by giving a temperature close to Ta3 as compared to a case in which a temperature close to Ta2 is given. This also applies to a case in which the heating time varies.

[Printhead]

The printhead according to this embodiment includes a substantially linear array of resistors extending across the width of an image. In this embodiment, the printhead extends in a direction (the width direction of the image material 10) orthogonal to the conveyance direction of the image material 10, and the resistors are provided along the width direction. Note that the width of the printhead may be shorter than the image. In this case, to process the image across its width, the printhead may be configured to move relative to the image material 10 that is a target image forming body, or may be used together with another printhead.

When a current is supplied to the resistors included in the printhead, the resistors operate as a heat source. When the image material 10 is conveyed while receiving the heat from the resistors of the printhead, imaging is performed in each image forming layer in accordance with the received heat. As described above, in this embodiment, the resistors are configured to irradiate the image material with infrared radiation. The time in which the printhead applies heat to the image material 10 typically ranges from about 0.001 to about 100 milliseconds for each line of the image. The upper limit is set in consideration of the balance to the printing time. The lower limit is defined by the restrictions of an electronic circuit (not shown). The interval of dots that form the image generally ranges from 100 to 600 lines per inch in both the conveyance direction and the width direction of the image material 10. Different intervals may be set in these directions.

Figure 3A:
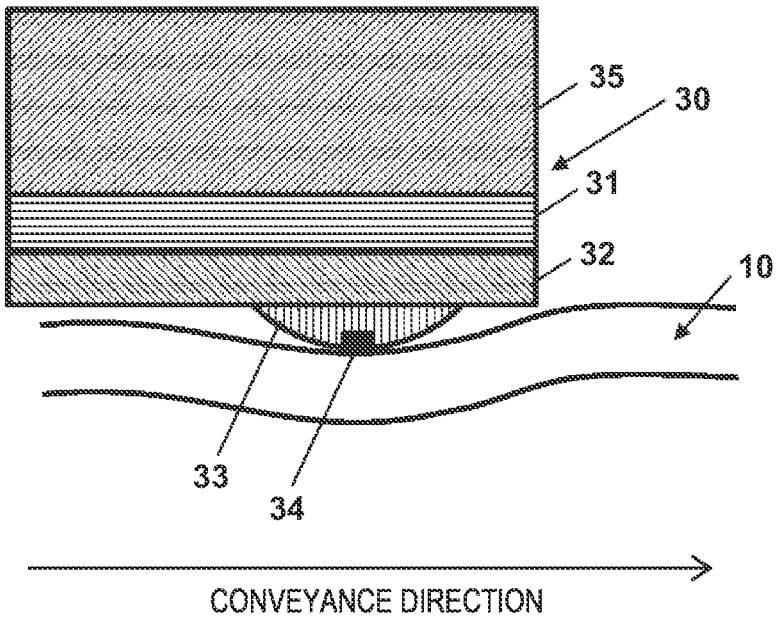
FIGS. 3A and 3B are views showing the arrangement of an image forming apparatus according to the embodiment.
Figure 3B:
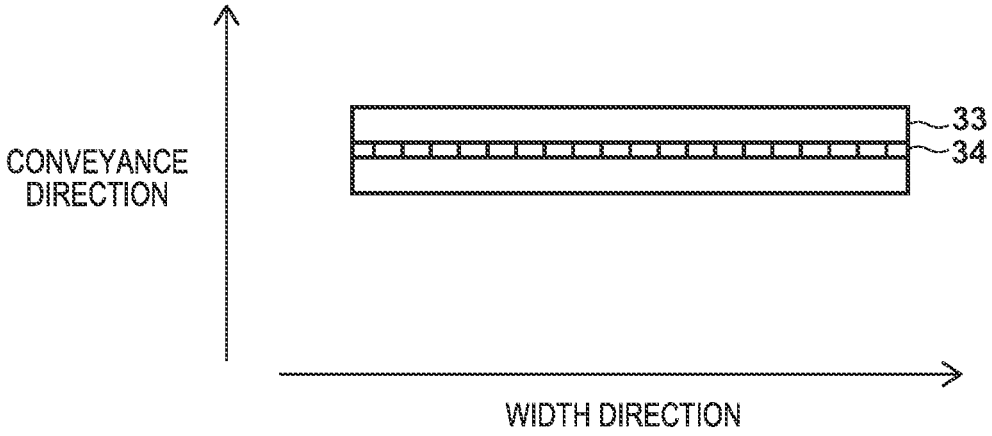

FIGS. 3A and 3B are views showing the printhead at the time of image formation and an example of the arrangement of the image material 10 according to this embodiment. Referring to FIG. 3A, the image material 10 is conveyed rightward at the time of image formation. The above-described width direction of the image material 10 corresponds to the depth direction in FIG. 3A. A printhead 30 includes a glaze 32 on a base 31. Additionally, in this embodiment, the glaze 32 further includes a convex glaze 33. A resistor 34 is arranged on the surface of the convex glaze 33, and is arranged so as to come into contact with the image material 10 conveyed in the conveyance direction. Note that the convex glaze 33 may have another shape or may be not provided. In this case as well, the resistor 34 is configured to come into contact with the image material 10. Note that a protective film layer (not shown) is preferably formed on the resistor 34, the glaze 32, and the convex glaze 33. The combination of the glaze 32 and the convex glaze 33, which are made of the same material, will generally be referred to as "the glaze of the printhead" hereinafter.

The base 31 and a heat sink 35 are provided on the glaze 32. The base 31 is in contact with the heat sink 35 and is cooled by a cooling unit (not shown) such as a fan. In general, the image material 10 comes into contact with the glaze of the printhead longer than the length of the actual heating resistor in the conveyance direction. A typical resistor has a length of about 120 μm in the conveyance direction of the image material 10. The thermal contact area between the image material 10 and the glaze of the general printhead is 200 μm or more.

FIG. 3B is a view showing an example of the array of the resistors 34 in the width direction. A plurality of resistors 34 are arrayed in the width direction and thus have a predetermined length in the width direction of the image material 10. An image of one line is formed along the array. In an example shown below, while conveying the image material 10 in the conveyance direction, an image is formed on a line basis.

[Image Forming Apparatus]

Figure 4:
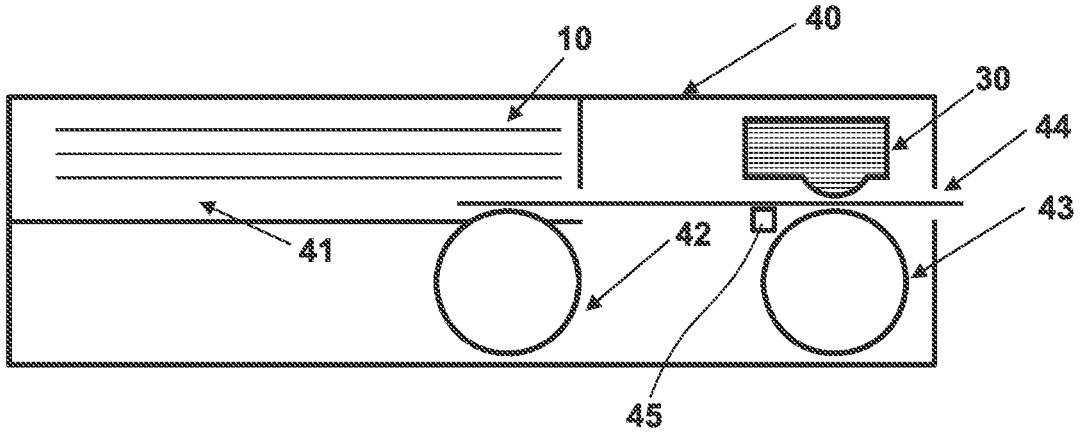
FIG. 4 is a view showing an example of a system arrangement according to the embodiment.

FIG. 4 is a sectional view showing an example of the arrangement of an image forming apparatus according to this embodiment. An image forming apparatus 40 includes the printhead 30, a storage unit 41, a conveyance roller 42, a platen 43, a discharge port 44, and a temperature sensor 45.

A plurality of image materials 10 can be stored as printing media in the storage unit 41. The image material 10 can be replenished by opening/closing a cover (not shown). At the time of printing, the image material 10 is fed to the printhead 30 by the conveyance roller 42, undergoes image formation between the platen 43 and the printhead 30, and is then discharged from the discharge port 44. The printing is thus completed. In addition, the temperature sensor 45 is provided on the periphery of the nip portion between the printhead 30 and the platen 43, and detects the temperature supplied by the printhead 30. Note that the target to be detected by the temperature sensor 45 may be, for example, the temperature of the resistor 34 (heat source) included in the printhead 30, or may be the surface temperature of the image material 10. In addition, the temperature sensor 45 is not limited to an arrangement for detecting the temperature of only one portion, and may be configured to detect temperatures of a plurality of portions. Furthermore, the temperature sensor 45 may be configured to detect the environmental temperature of the image forming apparatus 40.

The conveyance speed of the image material 10 is controlled based on the speed of image formation, the resolution at the time of image formation, and the like. For example, when forming a high-resolution image, the conveyance speed may be lowered as compared to a case of forming a low-resolution image. When priority is given to the printing speed, the conveyance speed may be increased, and the resolution may be reduced.

[System Arrangement]

Figure 5:
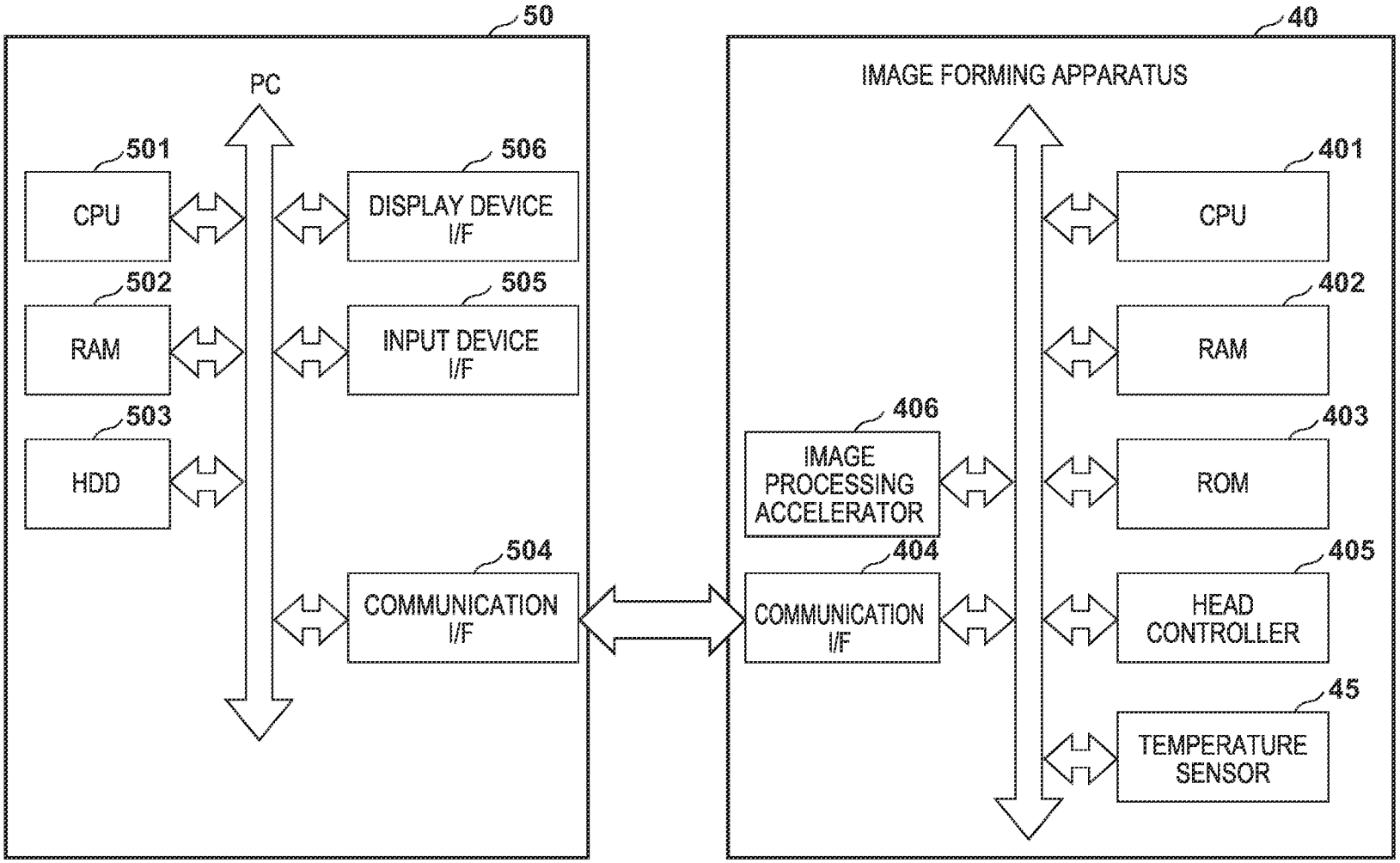
FIG. 5 is a view showing an example of the overall arrangement of the system according to the embodiment.

FIG. 5 is a view showing an example of the overall arrangement of a system according to this embodiment. As shown in FIG. 5, the system according to this embodiment includes the image forming apparatus 40 shown in FIG. 4, and a personal computer (PC) 50 serving as a host device for the apparatus.

The PC 50 includes a CPU (Central Processing Unit) 501, a RAM (Read Only Memory) 502, an HDD (Hard Disk Drive) 503, a communication I/F 504, an input device I/F 505, and a display device I/F 506. The portions are connected so as to be communicable with each other via an internal bus. The CPU 501 executes processing according to programs and various kinds of data held in the HDD 503 and the RAM 502. The RAM 502 is a volatile storage, and temporarily holds programs and data. The HDD 503 is a nonvolatile storage, and holds programs and data.

The communication I/F 504 is an interface configured to control communication with an external device, and controls data transmission/reception to/from the image forming apparatus 40 here. As the connection method of data transmission/reception here, wired connection such as USB, IEEE1394, or LAN (Local Area Network) or wireless connection such as Bluetooth®, or WiFi® can be used. The input device I/F 505 is an interface configured to control an HID (Human Interface Device) such as a keyboard or a mouse, and accepts an input from an input device by the user. The display device I/F 506 controls display on a display device such as a display (not shown).

The image forming apparatus 40 includes a CPU 401, a RAM 402, a ROM 403, a communication I/F 404, a head controller 405, an image processing accelerator 406, and the temperature sensor 45. The portions are connected so as to be communicable with each other via an internal bus. The CPU 401 executes processing according to each embodiment to be described later in accordance with programs and various kinds of data held in the ROM 403 and the RAM 402. The RAM 402 is a volatile storage, and temporarily holds programs and data. The ROM 403 is a nonvolatile storage, and holds table data and programs used in processing to be described later.

The communication I/F 404 is an interface configured to control communication with an external device, and controls data transmission/reception to/from the PC 50 here. The head controller 405 controls, based on print data, the heating operation for the printhead 30 shown in FIGS. 3A and 3B. More specifically, the head controller 405 can be configured to load control parameters and print data from a predetermined address of the RAM 402. When the CPU 401 writes the control parameters and the print data to a predetermined address of the RAM 402, processing is activated by the head controller 405, and the heating operation of the printhead 30 is performed.

The image processing accelerator 406 is formed by hardware, and executes image processing at a speed higher than that of the CPU 401. More specifically, the image processing accelerator 406 can be configured to load parameters and data necessary for image processing from a predetermined address of the RAM 402. When the CPU 401 writes the parameters and the data at a predetermined address of the RAM 402, the image processing accelerator 406 is activated, and predetermined image processing is performed. Note that the image processing accelerator 406 is not an always necessary element, and the above-described table parameter creation printing and image processing may be executed only by the processing of the CPU 401 in accordance with the specifications of the printer or the like. In addition, the temperature sensor 45 detects the ambient temperature of the resistor 34 of the printhead 30, as shown in FIG. 4, and provides the temperature information to the CPU 401 and the like. Based on the acquired temperature information, the CPU 401 generates control parameters used to control heat generation of the resistor 34. Detailed control will be described later.

Note that in this embodiment, the image forming apparatus 40 and the PC 50 have been described as different apparatuses. However, for example, these may be integrated to form the system, or the system may integrate the image forming apparatus 40 and an image capturing device (not shown). In addition, the PC has been exemplified as the host device. However, the present invention is not limited to this, and for example, a portable terminal such as a smartphone, a tablet terminal, or an image capturing device may be used.

[Print Service]

Figure 6:
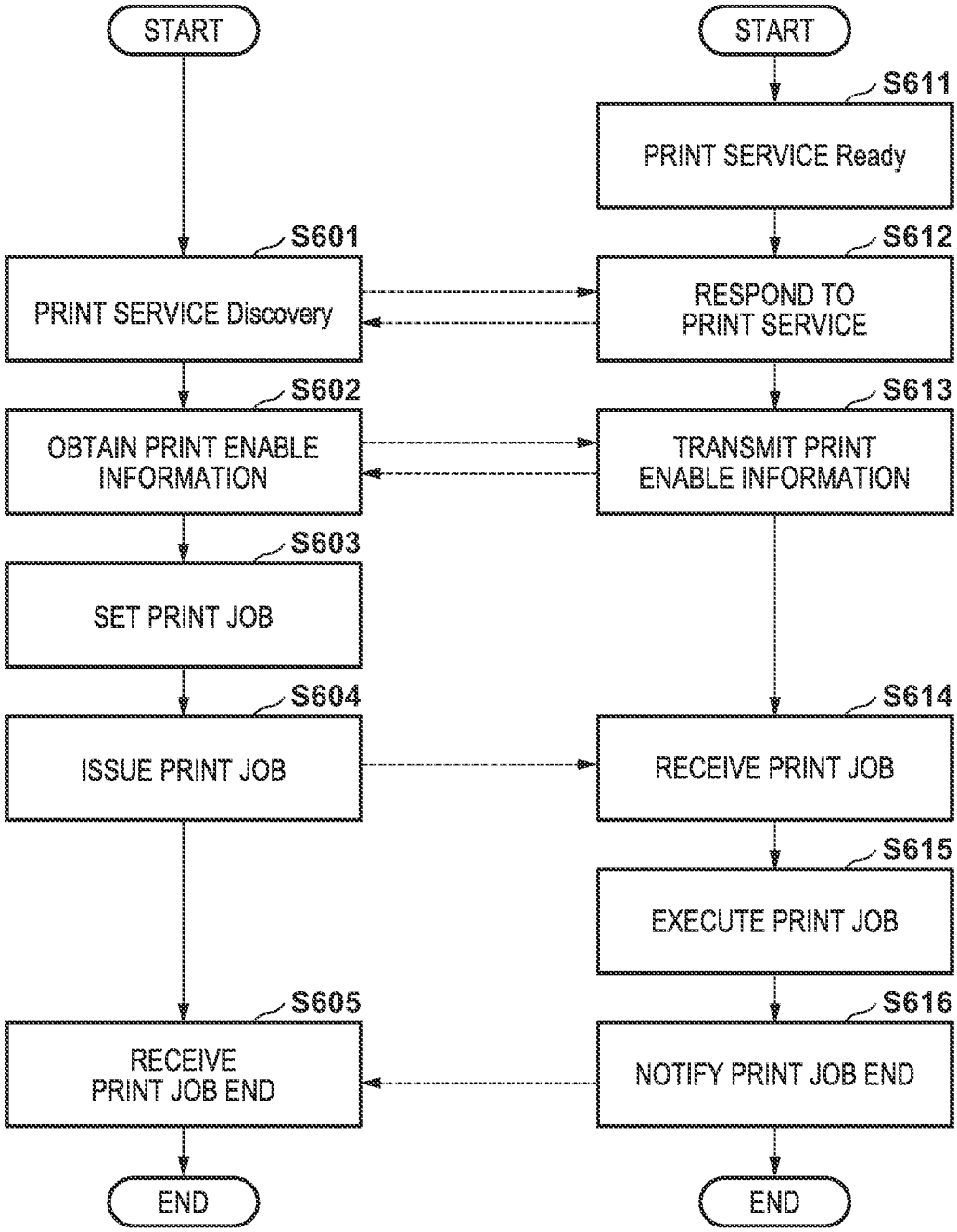
FIG. 6 is a sequence chart of a print service according to the embodiment.

FIG. 6 shows a sequence when executing a print service in the system according to this embodiment. In FIG. 6, steps S601 to S605 represent processing in the PC 50, and steps S611 to S616 represent processing of the image forming apparatus 40. Additionally, in FIG. 6, broken line arrows represent transmission/reception of data. The steps are implemented when the CPUs of the apparatuses read out programs held in the storage units and execute them. This sequence is started when the user is going to execute printing.

In step S611, after power on, the image forming apparatus 40 confirms that it can perform printing, determines that a print service can be provided, and transitions to a wait state.

On the other hand, in step S601, the PC 50 executes print service Discovery. In the print service Discovery here, a peripheral device may be searched for in accordance with a user operation, or an image forming apparatus capable of providing a print service may periodically be searched for. Alternatively, when the PC 50 and the image forming apparatus 40 are connected, the PC 50 may send a query.

In step S612, upon receiving the print service Discovery from the PC 50, as a response to this, the image forming apparatus 40 notifies the PC 50 that the image forming apparatus 40 is a device capable of providing a print service.

In step S602, upon receiving, from the image forming apparatus 40, the notification representing that a print service can be provided, the PC 50 requests print enable information for the image forming apparatus.

In step S613, as a response to the request of print enable information from the PC 50, the image forming apparatus 40 notifies the PC 50 of the information of the print service that the image forming apparatus can provide.

Upon receiving the print enable information from the image forming apparatus 40, in step S603, the PC 50 constructs a user interface for print job creation based on the print enable information. More specifically, based on the print enable information of the image forming apparatus 40, the PC 50 performs appropriate display of a print image designation, a print size, a printable sheet size, and the like and providing of appropriate options to the user via a display (not shown). Then, the PC 50 accepts settings from the user via an input device (not shown) such as a keyboard.

In step S604, the PC 50 issues a print job based on the accepted settings, and transmits it to the image forming apparatus 40.

In step S614, the image forming apparatus 40 receives the print job from the PC 50.

In step S615, the image forming apparatus 40 analyzes and executes the received print job. Details of image formation for the print job according to this embodiment will be described later.

When printing is completed, in step S616, the image forming apparatus 40 notifies the PC 50 of the printing completion. The processing on the side of the image forming apparatus 40 is thus completed, and the image forming apparatus 40 transitions to a wait state.

In step S605, the PC 50 receives the printing completion notification, and notifies the user of it. The processing on the side of the PC 50 is thus completed.

Note that in the above explanation, as for various kinds of information transmission, a communication example in which a request is sent from the side of the PC 50 to the image forming apparatus 40, and the image forming apparatus 40 responds to the request has been described. However, the present invention is not limited to a so-called Pull-type communication example as described above. A so-called Push-type communication in which the image forming apparatus 40 spontaneously performs the transmission to one or a plurality of PCs 50 existing on the network may be used.

Control of image formation according to this embodiment will be described below. In this embodiment, heating control is performed by outputting, from the head controller 405, a signal (pulse signal) configured to apply a current to the resistor 34 provided on the printhead 30.

(Conventional Heating Pulses)

Figure 7:
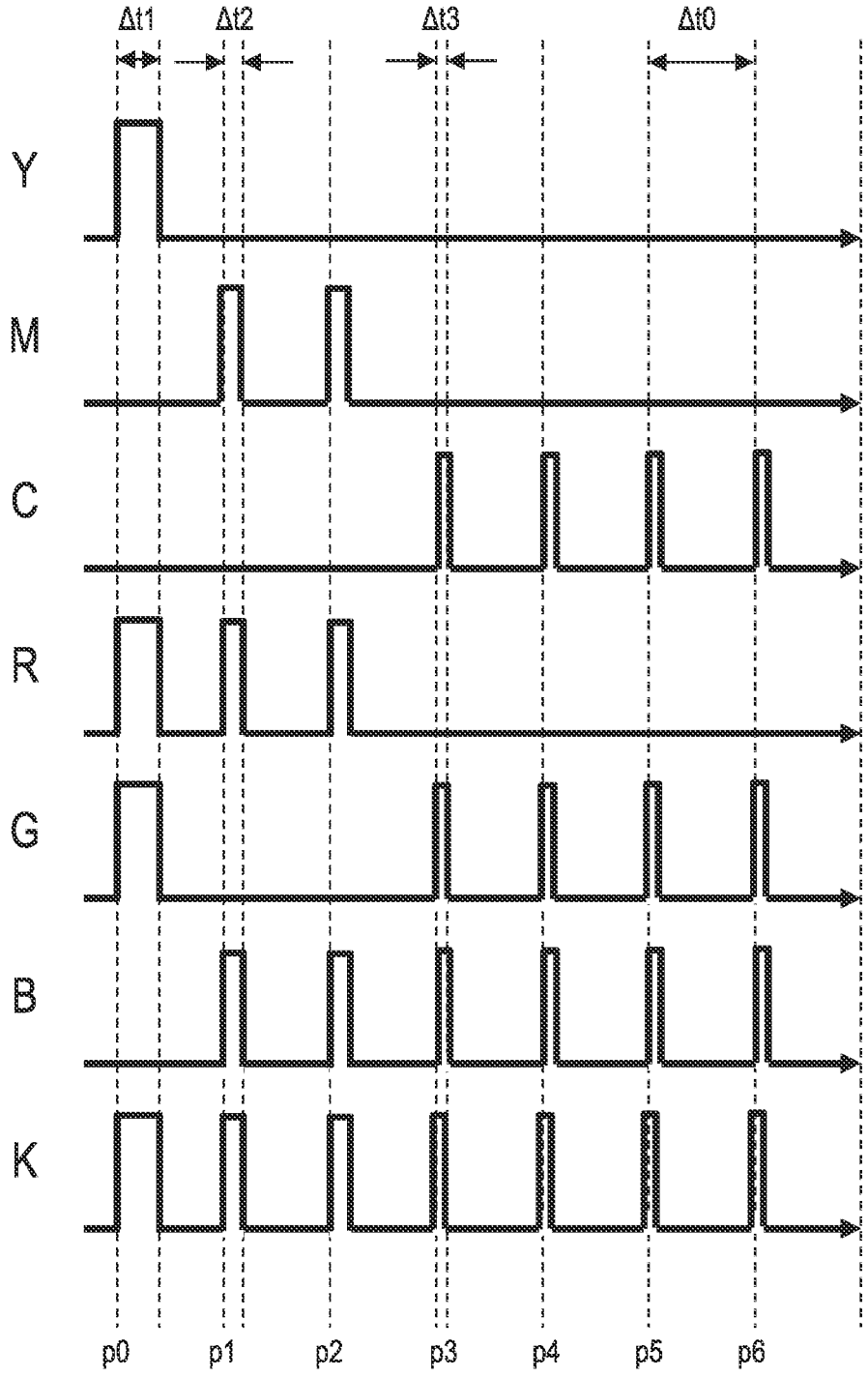
FIG. 7 is a view for explaining the arrangement of conventional heating pulses.

Signals used in conventional heating control will be described first as a comparative example to the present invention. FIG. 7 shows an example of signal patterns (heating pulses) corresponding to the colors which are applied to the printhead of a conventional image forming apparatus. FIG. 7 shows colors to be developed in the image material 10 in one pixel and an example of the arrangement of heating pulses at this time. FIG. 7 shows yellow (Y), magenta (M), cyan (C), red (R), green (G), blue (B), and black (K) sequentially from the upper side. In FIG. 7, a heating pulse for one pixel includes seven sections (p0 to p6), and the length of one section is Δt0. That is, the time of the heating pulse needed to form one pixel is Δt0×7 sections (p0 to p6). That is, for color development of one pixel, the number of cycles of pulses corresponding to seven sections are used. Color development is controlled by a pulse signal train included in this.

In FIG. 7, each signal exhibits two values by High and Low (ON and OFF). At High, heating by the resistor 34 is performed. At Low, heating is not performed. Color development is controlled by controlling the pulse widths of pulses included in the heating pulse for each color and the number of pulses. In this embodiment, the pulse width of each pulse is adjusted by PWM (Pulse width modulation) control. A description will be made by setting the start point of each section as the rise timing (ON timing) of a pulse, as shown in FIG. 7.

For example, for color development of yellow (Y), heating is performed for a time Δt1 to implement the region 21 (a relatively high heating temperature and a relatively short heating time) shown in FIG. 2. In addition, for color development of magenta (M), heating is executed for a time Δt2 twice in total at an interval to implement the region 22 (an intermediate heating temperature and an intermediate heating time) shown in FIG. 2. Here, the interval between the first pulse and the second is (Δt0−Δt2). Similarly, for color development of cyan (C), heating is executed for a time Δt3 four times in total at an interval to implement the region 23 (a relatively low heating temperature and a relatively long heating time) shown in FIG. 2. Here, the interval between the first pulse and the second is (Δt0−Δt3). By providing the interval, it is possible to suppress an increase in the temperature of the image material 10 beyond the target temperature (activation temperature). In other words, the target temperature is maintained by controlling the ON time and the OFF time.

In FIG. 7, for easy understanding, a relationship given by

Δt1=Δt2×2=Δt3×4 is set, and the total time of heating pulses applied to the printhead 30 is the same regardless of the color to be developed. Assume that t1 to t3 and Ta1 to Ta3 to be described below correspond to the description of FIG. 2.

As for the heating times, t2>heating time Δt1 of Y>t1 t3>heating time Δt2 of M+Δt0>t2 heating time Δt3 of C+Δt0×3>t3 hold, and the relative relationship between the heating times is given by

Y<M<C

Here, the energy (heat amount) applied to the image material 10 by the printhead 30 is thermally conducted to the glaze 32 (and the convex glaze 33), the base 31, and the heat sink 35 of the printhead 30 shown in FIGS. 3A and 3B in the interval time of each signal. For this reason, the temperature of the image material 10 lowers during the interval time. Similarly, since the heat amount thermally conducted into the image material 10 propagates the heat to the periphery of the platen 43 and the like shown in FIG. 4 as well, the temperature of the image material 10 lowers accordingly. As a result, in a case in which the applied energy (heat amount) is the same, the peak temperatures by heating hold a relationship given by

Y>M>C

Here, when control is performed to satisfy peak temperature of Y>Ta3

Ta3>peak temperature of M>Ta2

Ta2>peak temperature of C>Ta1 the colors Y, M, and C can be developed independently.

Heating pulses that control the color development of R, G, and B that are secondary colors and K that is a tertiary color will be described next. Here, an Nth-degree color means a color expressed by developing N color materials (image forming layers) and combining them.

For red (R) shown in FIG. 7, the heating pulse is controlled to develop yellow (Y)→magenta (M) in this order. That is, the image forming layer 14 corresponding to yellow (Y) and the image forming layer 16 corresponding to magenta (M) are caused to develop the colors, thereby forming an image of red (R). Additionally, for green (G) shown in FIG. 7, the heating pulse is controlled to develop yellow (Y)→cyan (C) in this order. Similarly, for blue (B) shown in FIG. 7, the heating pulse is controlled to develop magenta (M)→cyan (C) in this order. For black (K) shown in FIG. 7, the heating pulse is controlled to develop yellow (Y)→magenta (M)→cyan (C) in this order.

In the above-described conventional method, since color development is performed under the conditions that

- when developing the color of the Y layer, the C layer and the M layer are not caused to develop the colors,
- when developing the color of the M layer, the Y layer and the C layer are not caused to develop the colors, and
- when developing the color of the C layer, the M layer and the Y layer are not caused to develop the colors, there are restrictions for activation of each image forming layer. That is, since the image forming layers are individually caused to develop the colors, sufficient reproduction cannot be performed in the combination at the time of color development. For this reason, the color development ratio of each image forming layer in the image material 10 is low, and this makes the color development insufficient.

(Activation According to Present Invention)

In this embodiment, control is performed in the following way in consideration of the above-described problems of the conventional activation.

Figure 8:
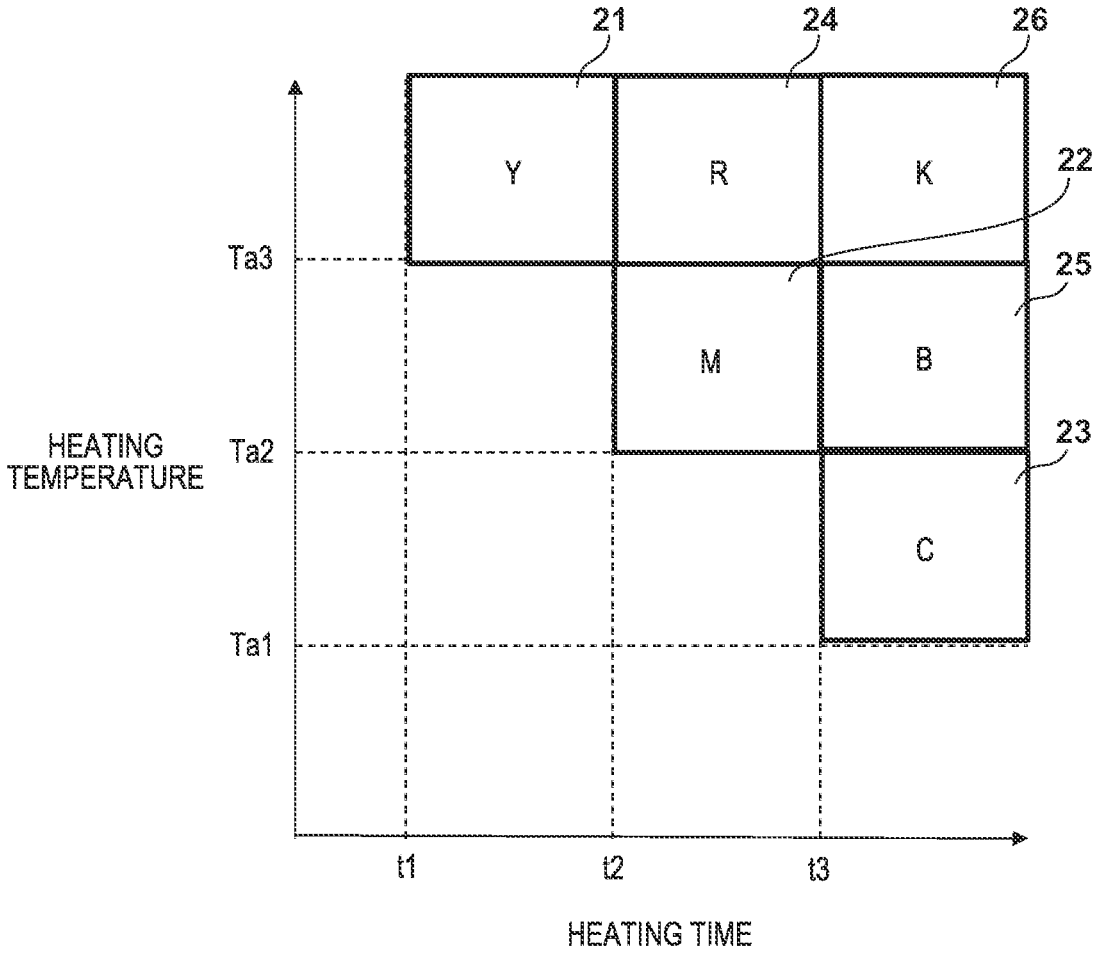
FIG. 8 is a view for explaining activation of image forming layers according to the embodiment.

FIG. 8 is a view for explaining the relationship between heating times and heating temperatures according to this embodiment. The regions 21, 22, and 23 shown in FIG. 8 are the same as the regions 21, 22, and 23 shown in FIG. 2, and a description thereof will be omitted.

A region 24 is a region in which the image forming layer 14 corresponding to yellow (Y) and the image forming layer 16 corresponding to magenta (M) in the image forming layers 14, 16, and 18 shown in FIG. 1 are activated. Hence, when energy corresponding to the region 24 is added, substantially color development in the image material 10 is red (R).

A region 25 is a region in which the image forming layer 16 corresponding to magenta (M) and the image forming layer 18 corresponding to cyan (C) in the image forming layers 14, 16, and 18 shown in FIG. 1 are activated. Hence, when energy corresponding to the region 25 is added, substantially color development in the image material 10 is blue (B).

A region 26 is a region in which all the image forming layers 14, 16, and 18 shown in FIG. 1 are activated. Hence, when energy corresponding to the region 26 is added, substantially color development in the image material 10 is black (K).

In the conventional example, the regions 24, 25, and 26 are not used because a plurality of color development layers are activated simultaneously in parallel. In this embodiment, however, the regions 24 to 26 are used in addition to the conventionally used regions 21 to 23, thereby improving color development (color reproducibility) in the image material 10.

(Heating Pulses According to This Embodiment)

The basic arrangement of the heating pulses according to this embodiment will be described next with reference to FIG. 9.

Figure 9:
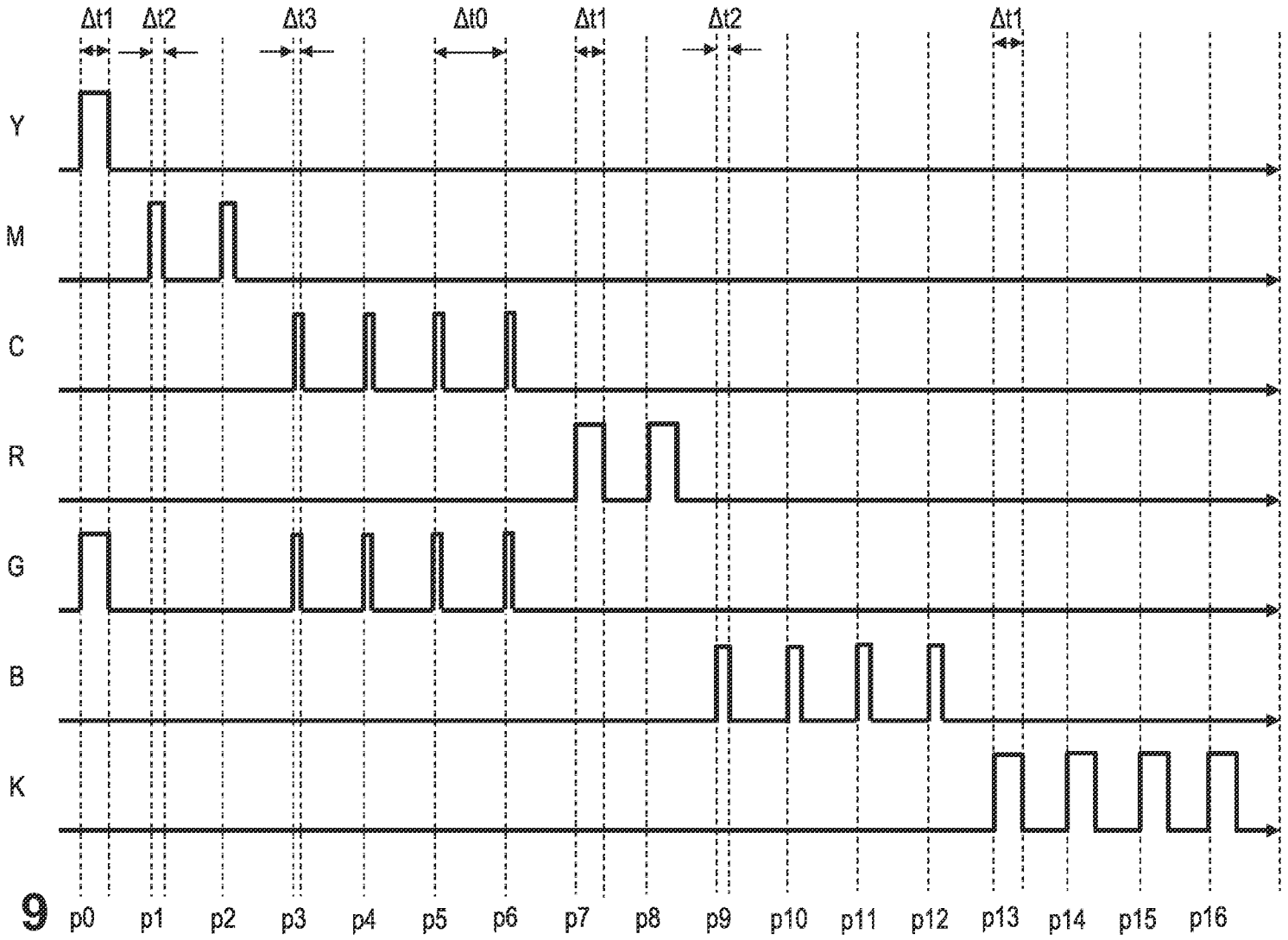
FIG. 9 is a view for explaining the arrangement of heating pulses according to the first embodiment.

In FIG. 9, Y, M, C, and G shown as the heating pulses in FIG. 7 remain unchanged, but the heating pulses for R, B, and K are changed. In this embodiment, the heating pulses are controlled to develop Y→M→C→R→B→K in this order. Note that the pulse widths and the interval periods ($\Delta t0$, $\Delta t1$, $\Delta t2$, $\Delta t3$, and the like) can be decided in accordance with the cooling characteristic of the interval time derived from the structures of the printhead 30 and other components.

For example, for color development of red (R) that is a secondary color, heating is executed for the time $\Delta t1$ twice in total at an interval of ($\Delta t0$-$\Delta t1$). This means that heating is performed for a time for developing magenta (M) at a temperature for developing yellow (Y). That is, energy corresponding to the region 24 shown in FIG. 8 is added. In this control, magenta (M) can be developed using the temperature until reaching the temperature for developing yellow (Y), as compared to the conventional method in which yellow (Y) and magenta (M) are independently developed. For this reason, the color development of magenta (M) is improved. In addition, since yellow (Y) can be developed simultaneously in parallel using the time needed to develop magenta (M), the area ratio of the color development of yellow (Y), that is, the color development area per pixel is improved, and accordingly, the color development efficiency of yellow (Y), that is, the color development degree per pixel is improved.

Similarly, for color development of blue (B) that is a secondary color, heating is executed for the time $\Delta t2$ four times in total at an interval of ($\Delta t0$-$\Delta t2$). This means that heating is performed for a time for developing cyan (C) at a temperature for developing magenta (M). That is, energy corresponding to the region 25 shown in FIG. 8 is added. In this control, cyan (C) can be developed using the temperature until reaching the temperature for developing magenta (M), as compared to the conventional method in which magenta (M) and cyan (C) are independently developed. For this reason, the color development of cyan (C) is improved. In addition, since magenta (M) can be developed simultaneously in parallel using the time needed to develop cyan (C), the area ratio of the color development of magenta (M) is improved, and accordingly, the color development efficiency of magenta (M) is improved.

Similarly, for color development of black (K) that is a tertiary color, heating is executed for the time AU four times in total at an interval of ($\Delta t0$–$\Delta t1$). This means that heating is performed for a time for developing cyan (C) at a temperature for developing yellow (Y). That is, energy corresponding to the region 26 shown in FIG. 8 is added. In this control, magenta (M) and cyan (C) can be developed using the temperature until reaching the temperature for developing yellow (Y), as compared to the conventional method in which yellow (Y), magenta (M), and cyan (C) are independently developed. For this reason, the color development of magenta (M) and cyan (C) is improved. In addition, yellow (Y) and magenta (M) can be developed simultaneously in parallel using the time needed to develop cyan (C). For this reason, the area ratios of the color development of yellow (Y) and magenta (M) are improved, and accordingly, the color development efficiencies of yellow (Y) and magenta (M) are improved.

[Processing Procedure]

Figure 10:
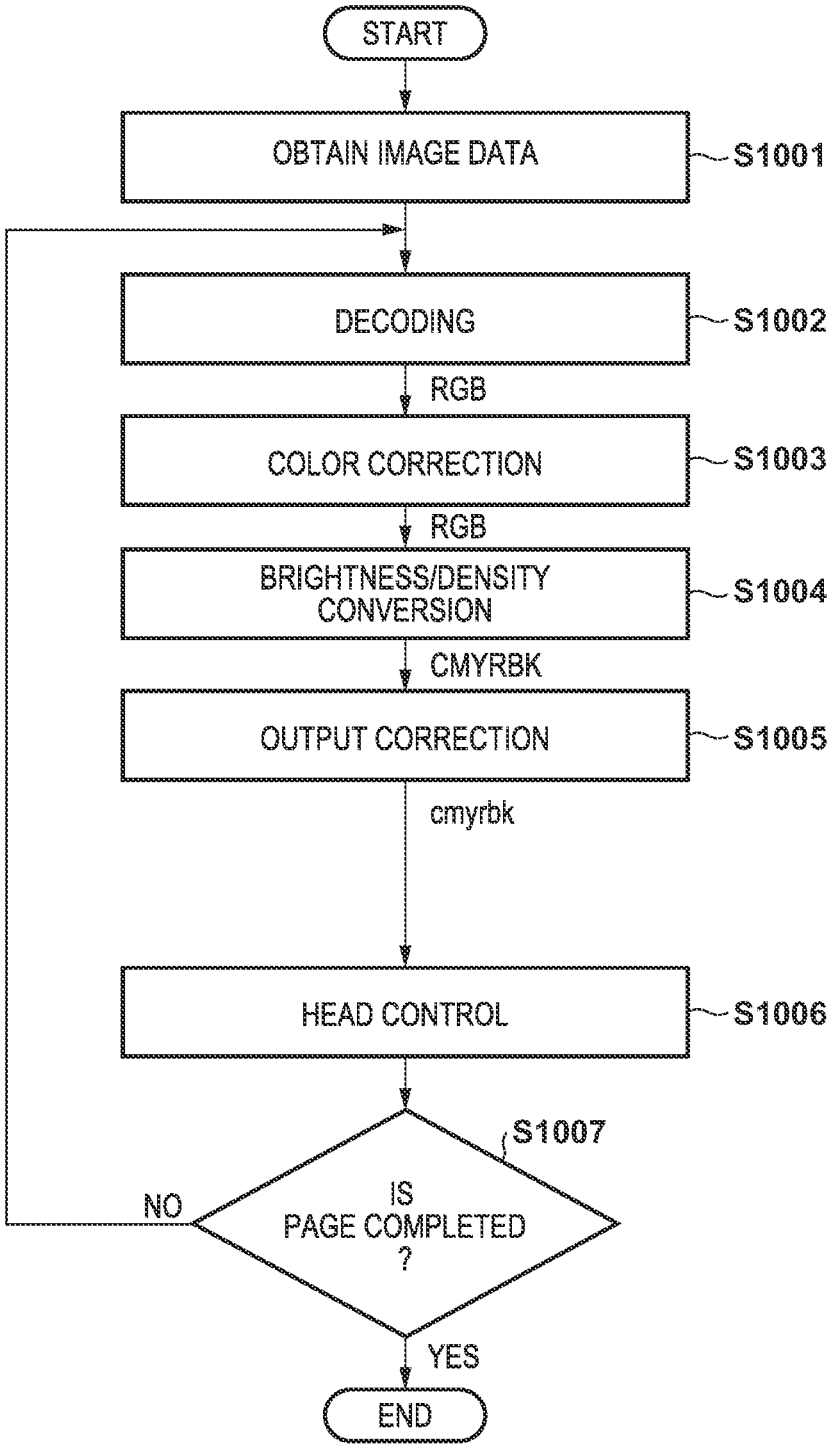
FIG. 10 is a flowchart of processing at the time of image formation according to the first embodiment.

FIG. 10 is a flowchart of image processing for implementing the heating pulses according to this embodiment. The procedure shown in FIG. 10 is executed in the processing of step S615 shown in FIG. 6. This procedure is implemented when, for example, the CPU 401 of the image forming apparatus 40 reads out programs and data included in the ROM 403 or the like and executes them. Note that this processing may partially be executed by the image processing accelerator 406.

In step S1001, the CPU 401 acquires image data in the print job received in step S614 of FIG. 6. A description will be made here assuming that the image data is acquired on a page basis.

In step S1002, the CPU 401 performs decoding processing for the image data. Note that if the image data is not compressed or encoded, this processing may be omitted. The image data changes to RGB data by the decoding processing. As the type of RGB data, for example, standard color information such as sRGB or Adobe® RGB is usable. In this embodiment, the image data may have 8-bit information ranging from 0 to 255 for each color. However, the image data may be formed by information of another number of bits, for example, 16-bit information.

In step S1003, the CPU 401 performs color correction processing for the image data. Note that the color correction processing may be performed on the side of the PC 50, or may be performed in the image forming apparatus 40 in a case of performing color correction according to the image forming apparatus 40. The image data after the color correction processing is RGB data. At this point of time, the RGB data has a format of RGB specialized to the image forming apparatus 40, that is, so-called device RGB.

In step S1004, the CPU 401 performs brightness/density conversion for the image data using a three-dimensional lookup table. In the pulse control according to this embodiment, not 3-color to 3-color conversion expressed as

R, G, B→C, M, Y but 3-color to 6-color conversion expressed as

R, G, B→C, M, Y, R, B, K is performed. Hence, brightness/density conversion using a method such as a three-dimensional lookup table is preferably performed. That is, as colors that can be reproduced by combining the color developments of the three image forming layers, the values of R, B, and K are also calculated.

In this embodiment, brightness/density conversion is performed using a three-dimensional lookup table in the following way. In a function 3D_LUT[R][G][B][N] of the three-dimensional lookup table used below, the values of the RGB data are input to variables R, G, and B, respectively. For a variable N, one of the values C, M, Y, R, B, and K to be output is designated. Here, assume that 0, 1, 2, 3, 4, and 5 are designated as C, M, Y, R, B, and K here.

C=3D_LUT[R][G][B][0]
M=3D_LUT[R][G][B][1]
Y=3D_LUT[R][G][B][2]
R=3D_LUT[R][G][B][3]
B=3D_LUT[R][G][B][4]
K=3D_LUT[R][G][B][5]

The above-described 3D_LUT is formed by 256×256×256×6=100,663,296 data tables. Each data is data corresponding to the pulse width applied in p0 to p16 in FIG. 9. Note that to decrease the data amount of the lookup table, for example, the number of grids may be decreased from 256 to 17, and a result may be calculated by an interpolation operation using 17×17×17×6=29,478 data tables. As a matter of course, the number of grids may appropriately be set to a number other than 17, for example, 16, 9, or 8. As the interpolation method, any method such as known tetrahedral interpolation can be used. In this embodiment, the three-dimensional lookup table is defined in advance and held in the ROM 403 of the image forming apparatus 40, or the like.

When the above-described three-dimensional lookup table is used, the control parameters of yellow (Y), magenta (M), and cyan (C), which form the colors, can individually be set. That is, it is possible to independently set the control parameters for each of yellow and magenta which form red (R), cyan and yellow which form green (G), magenta and cyan which form blue (B), and yellow, magenta, and cyan which form black (K). Additionally, in a case of using a plurality of pulses when developing one color like cyan (C) or magenta (M), as shown in FIG. 9, the plurality of pulses may be controlled to the same pulse width, or may be controlled to different pulse widths. This makes it possible to more finely control color development and contribute to improvement of the reproducibility of colors.

Other than the three-dimensional lookup table, the values can also be calculated by operations like C=255−R
M=255−G
Y=255−B
K=min(C, M, Y)
C=C−K
M=M−K
Y=Y−K
R=min(M, Y)
B=min(M, C)
C=C−B
M=M−B−R
Y=Y−R A suitable means may appropriately be used. The function min(x, y) shown above is a function of selecting the minimum value of variables x and y.

In step S1005, the CPU 401 performs output correction for the converted image data. First, the CPU 401 calculates pulse widths to implement the densities of C, M, Y, R, B, and K using conversion tables corresponding to the colors. Values c, m, y, r, b, and k represent pulse widths corresponding to the values of C, M, Y, R, B, and K, respectively. The conversion tables (conversion formulas) here are defined in advance and held in the ROM 403 of the image forming apparatus 40, or the like.

c=1D_LUT[C]
m=1D_LUT[M]
y=1D_LUT[Y]
r=1D_LUT[C]
b=1D_LUT[M]
k=1D_LUT[Y]

Here, the maximum value of the pulse width represented by c is Δt3 in FIG. 9. The maximum value of the pulse width represented by m is Δt2 in FIG. 9. The maximum value of the pulse width represented by y is Δt1 in FIG. 9. The maximum value of the pulse width represented by r is Δt1 in FIG. 9. The maximum value of the pulse width represented by b is Δt2 in FIG. 9. The maximum value of the pulse width represented by k is Δt1 in FIG. 9. The image forming apparatus 40 can modulate the color development intensity in the image material 10 by modulating the pulse widths. For this reason, if the above-described values c, m, y, r, b, and k are smaller than the maximum values, a desired tone can be implemented by appropriately shortening the pulse widths. This processing may be performed using a known means.

In addition, the CPU 401 modulates the heating pulses in accordance with the temperature of the image material 10 (or the printhead 30) acquired by the temperature sensor 45. More specifically, control is performed to shorten the pulse width of the heating pulse used to make the temperature reach the activation temperature along with an increase in the temperature detected by the temperature sensor 45. This processing may be performed using a known means. As for the temperature of the image material 10, the temperature need not always be acquired by the temperature sensor 45. The temperature of the image material 10 or the printhead 30 may be estimated in the PC or the image forming apparatus 40, and control may be performed based on the estimated temperature. The temperature estimation method is not particularly limited, and a known method may be used.

Note that if the temperature of the image material 10 rises beyond an allowable temperature, the image forming operation is preferably waited (interrupted). After the temperature of the image material 10 falls below the allowable temperature, the image formation is preferably resumed. If image formation is waited halfway through image formation of one page, it is not easy to make the image formation density before the waiting match that after resumption of image formation. For this reason, it is preferable to determine the presence/absence of wait in step S1001, wait on a page basis, and perform resumption after that.

In step S1006, the CPU 401 controls the printhead 30 via the head controller 405. More specifically, using the pulse widths obtained above, following signals associated with 17 sections (p0 to p16) shown in FIG. 9 are output. p0 to p16 below correspond to the sections shown in FIG. 9, respectively.

p0=y
p1=m
p2=m
p3=c
p4=c
p5=c
p6=c
p7=r
p8=r
p9=b
p10=b
p11=b
p12=b
p13=k
p14=k
p15=k
p16=k

As described above, a desired color is formed on the image material 10 by controlling the pulse widths in p0 to p16.

In step S1007, the CPU 401 determines whether the printing of the page is completed. If the printing is completed (YES in step S1007), the processing procedure is ended, and the process advances to processing of the next page or the processing of step S616 of FIG. 6. If the printing is not completed (NO in step S1007), the process returns to step S1002 to continue the image formation processing for the page.

Referring to FIG. 9, conventionally, for red (R), yellow (Y) is developed in p1, and magenta (M) is developed in p2+p3. In this embodiment, however, yellow (Y) and magenta (M) are developed in both p7 and p8. Accordingly, the color development is improved, and image quality is improved.

Note that in this embodiment, the total number of driving pulses increases to 17 sections (p0 to p16) as compared to the conventional seven sections (p0 to p6). Hence, heating by the printhead 30 and conveyance of the image material 10 are preferably performed not simultaneously but alternately.

[Wait Processing]

Wait determination of image formation has been described concerning the description of the output correction in step S1005 of FIG. 10. As described above, as for the wait determination, since the temperature of each image forming layer rises along with an increase in the temperature of the image material 10 itself, an image of different image quality is formed if the same energy (heat) is given to the image material 10 of a different temperature. For this reason, depending on the temperature of the image material 10, it is necessary to temporarily stop image formation and wait until the temperature lowers. In the processing according to this embodiment, the wait determination can be performed more effectively as compared to the conventional method, and the processing will be described in detail.

As described above, in the conventional method, it is necessary to satisfy the conditions that

- when developing the color of the Y layer, the C layer and the M layer are not caused to develop the colors,
- when developing the color of the M layer, the Y layer and the C layer are not caused to develop the colors, and
- when developing the color of the C layer, the M layer and the Y layer are not caused to develop the colors. In particular, in a state in which the temperature of the image material 10 is close to the activation temperature of the C layer, it is difficult to control to satisfy the color development conditions of the M layer and the Y layer.

On the other hand, in the method according to this embodiment, the conditions are

- when developing the color of the R layer, the C layer is not caused to develop the color,
- when developing the color of the B layer, the Y layer is not caused to develop the color, and
- when developing the color of the K layer, there are no layers that do not develop the colors.

There are less restrictions as compared to the conventional method. More specifically,

- for an image of R, pulse application time<T3 suffices, and no temperature condition exists,
- for an image of B, temperature<Ta3 suffices, and no application time condition exists,
- for an image of K, there are neither temperature condition nor application time condition. However, in a state in which the temperature of the image material 10 is close to the activation temperature of the C layer, the degree of condition relaxation of red (R) is relatively smaller as compared to blue (B) and black (K).

Hence, when performing wait determination of image formation, for an image in which R, B, K, and C are dominant (the ratios in the image are high), and there is little image formation of M and Y, the continuity of printing can be improved by relaxing the wait conditions.

More specifically, a temperature (wait temperature) that is be used to perform wait determination and needs wait for each color is set. In this case, at least

K, B, R, C>Y, M is set, and a wait temperature higher than those of Y and M can be set for one of K, B, R, and C. The wait temperatures may be set divisionally for two groups, or individual wait temperatures for the colors may be set. With an arrangement for setting the minimum wait temperature in the colors that form images in at least a predetermined area or more is employed, it is possible to set an appropriately wait temperature that does not cause wasteful wait in a state where an image defect does not occur.

(Wait Determination Processing)

Figure 18:
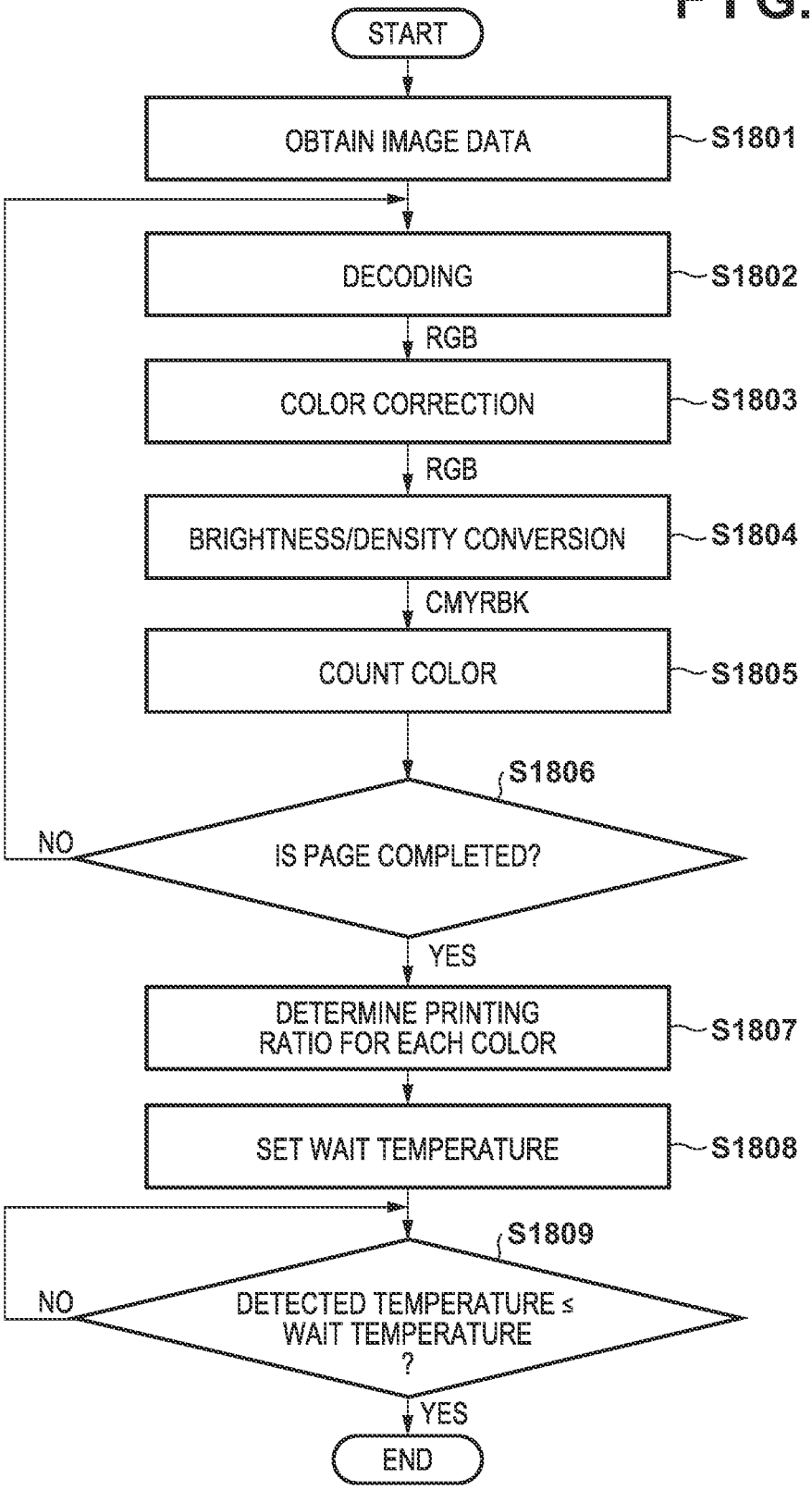
FIG. 18 is a flowchart of wait processing at the time of image formation according to the present invention.

FIG. 18 is a flowchart of wait processing at the time of image formation according to this embodiment. An example in which this processing is performed before printing of a page of interest starts at the timing of the start of the processing of step S1001 in FIG. 10, as described above, will be described. This procedure is implemented when, for example, the CPU 401 of the image forming apparatus 40 reads out programs and data included in the ROM 403 or the like and executes them. Note that this processing may partially be executed by the image processing accelerator 406.

In step S1801, the CPU 401 acquires image data. At this time, variables (Total) and flags (Judge) used to perform cumulative counting of the colors for the image data are initialized.

TotalC=0 JudgeC=FALSE
TotalM=0 JudgeM=FALSE
TotalY=0 JudgeY=FALSE
TotalR=0 JudgeR=FALSE
TotalB=0 JudgeB=FALSE
TotalK=0 JudgeK=FALSE In steps S1802 to S1804, the same processing as in steps S1002 to S1004 of FIG. 10 is performed.

In step S1805, the CPU 401 cumulatively counts each of the amounts of C, M, Y, R, B, and K obtained so far in one page. More specifically, the cumulative density value of the variable Total corresponding to each color initialized in step S1801 is cumulatively added on a pixel basis, thereby obtaining the frequency of each color.

TotalC=TotalC+C
TotalM=TotalM+M
TotalY=TotalY+Y
TotalR=TotalR+R
TotalB=TotalB+B
TotalK=TotalK+K In step S1806, the CPU 401 determines whether the cumulative counting is performed for all pixels included in the page. If the cumulative counting is performed for all pixels (YES in step S1806), the process advances to step S1807. If the cumulative counting is not performed for all pixels (NO in step S1806), the process returns to step S1802 to continue the processing.

In step S1807, the CPU 401 determines, for each color using the result of counting for each color, whether an area of a predetermined amount or more is printed. More specifically, the processing is performed based on the following conditions. In the example below, IF functions will be exemplified.

If(TotalC>Threshold) JudgeC=TRUE
If(TotalM>Threshold) JudgeM=TRUE
If(TotalY>Threshold) JudgeY=TRUE
If(TotalR>Threshold) JudgeR=TRUE
If(TotalB>Threshold) JudgeB=TRUE
If(TotalK>Threshold) JudgeK=TRUE In the above-described example, the threshold Threshold is set as a printing ratio for all pixels to, for example, 1%. For a color equal to or more than Threshold, a wait temperature for a suitable image formation result needs to be set. As for the value of the threshold Threshold, a value common to all colors is used in this embodiment. However, different values may be set for the colors.

In step S1808, the CPU 401 decides the wait temperature for the whole. In the case of Judge=TRUE, it is necessary to wait until the detected temperature drops down to a temperature Temp that is below the reference temperature even if printing for Total is performed. Here, let Temp be a temperature at which Total=Threshold. Temp can be expressed as follows by a factor f for converting a cumulative count of density values into temperature.

TempC=f×(Threshold−TotalC)
TempM=f×(Threshold−TotalM)
TempY=f×(Threshold−TotalY)
TempR=f×(Threshold−TotalR)
TempB=f×(Threshold−TotalB)
TempK=f×(Threshold−TotalK)

However, since Temp is affected not only by one cumulative count but also by all cumulative counts, a contribution rate of each cumulative count may be expressed as a as follows.

TempC=f×Threshold−f×(a_cc×TotalC+a_cm×TotalM+a_cy×TotalY+a_cr×TotalR+a_cb×TotalB+a_ck×TotalK)
TempM=f×Threshold−f×(a_mc×TotalC+a_mm×TotalM+a_my×TotalY+a_mr×TotalR+a_mb×TotalB+a_mk×TotalK)
TempY=f×Threshold−f×(a_yc×TotalC+a_ym×TotalM+a_yy×TotalY+a_yr×TotalR+a_yb×TotalB+a_yk×TotalK)
TempR=f×Threshold−f×(a_rc×TotalC+a_rm×TotalM+a_ry×TotalY+a_rr×TotalR+a_rb×TotalB+a_rk×TotalK)
TempB=f×Threshold−f×(a_bc×TotalC+a_bm×TotalM+a_by×TotalY+a_br×TotalR+a_bb×TotalB+a_bk×TotalK)
TempK=f×Threshold−f×(a_kc×TotalC+a_km×TotalM+a_ky×TotalY+a_kr×TotalR+a_kb×TotalB+akk×TotalK)

An initial value TempDefault is set as a wait temperature WaitTemp. This value is a wait temperature in a case in which a sheet that remains almost white is discharged. If a lower wait temperature is needed for a color that needs image formation, the temperature is set as the wait temperature. The following conditions represented by IF functions are merely examples, and the present invention is not limited to this. In addition, the determination order is not limited to the example shown below, and may be decided in accordance with the color development characteristic of each image forming layer.

WaitTemp=TempDefault
If(JudgeC=TRUE && TempC<WaitTemp) WaitTemp=TempC
If(JudgeM=TRUE && TempM<WaitTemp) WaitTemp=TempM
If(JudgeY=TRUE && TempY<WaitTemp) WaitTemp=TempY
If(JudgeR=TRUE && TempR<WaitTemp) WaitTemp=TempR
If(JudgeB=TRUE && TempB<WaitTemp) WaitTemp=TempB
If(JudgeK=TRUE && TempK<WaitTemp) WaitTemp=TempK In step S1809, the CPU 401 determines whether the temperature detected by the temperature sensor 45 is equal to or less than the wait temperature. If the temperature is not equal to or less than the wait temperature (NO in step S1809), the processing waits until the temperature becomes equal to or less than the wait temperature. If the temperature is equal to or less than the wait temperature (YES in step S1809), the processing procedure is ended, and the process returns to the processing of step S1001 in FIG. 10. Note that when the process returns to the processing of step S1001, the result obtained by the processing of steps S1802 to S1804 in FIG. 18 may be reused without performing the processing of steps S1002 to S1004 in FIG. 10.

Modification of First Embodiment

In the above-described first embodiment, an example in which the color development on the image material 10 is improved by using dedicated heating pulses for red (R) and blue (B) that are secondary colors and black (K) that is a tertiary color, as shown in FIG. 9, has been described. However, as is apparent from the comparison of FIGS. 7 and 9, in the first embodiment, the total number of driving pulses increases to double or more. Hence, in this modification, an example in which the color development in a specific color gamut is improved on the image material 10 while suppressing the increase ratio of the total number of driving pulses will be described.

(Heating Pulses)

Figure 11:
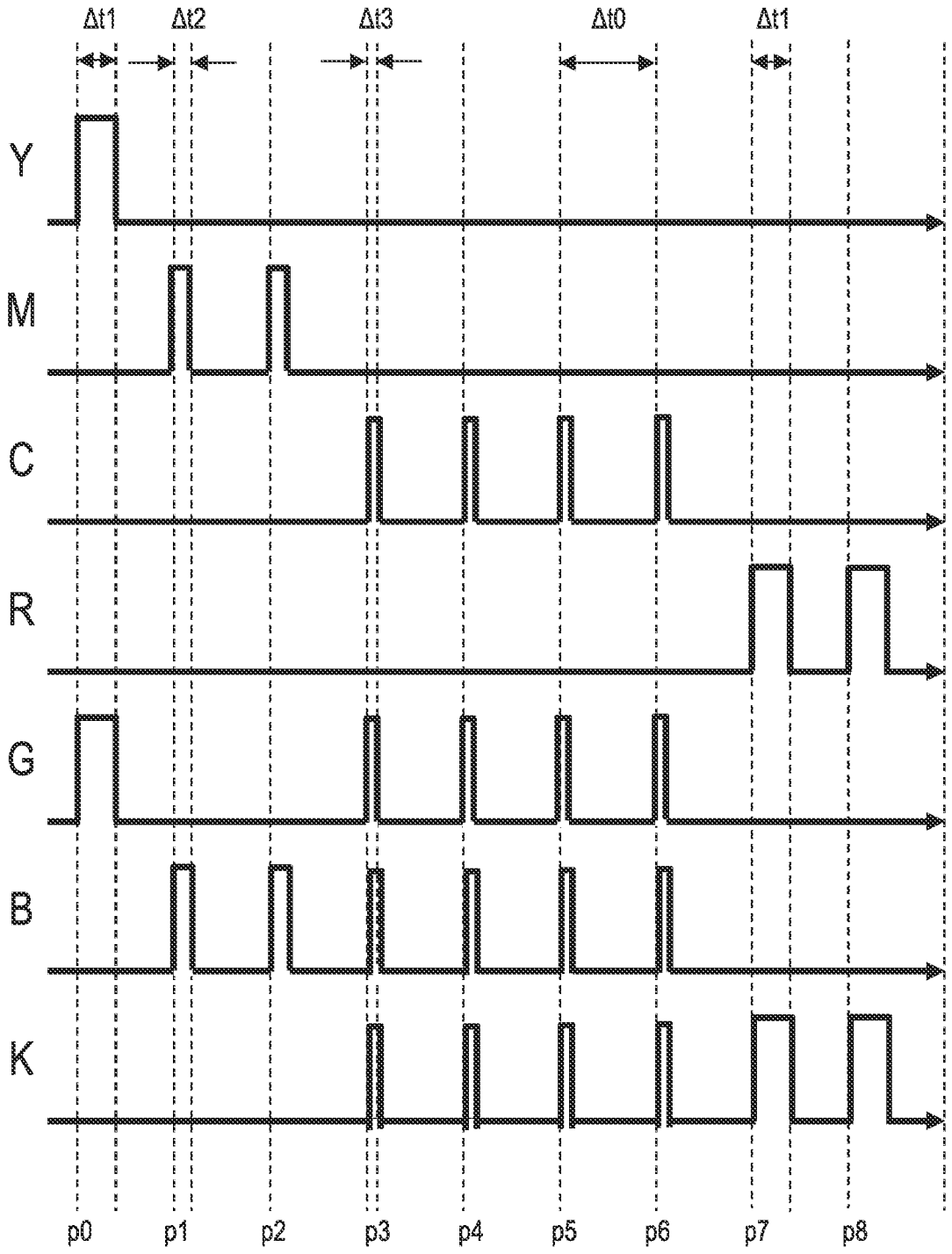
FIG. 11 is a view for explaining the arrangement of heating pulses according to a modification of the first embodiment.

FIG. 11 is a view for explaining an example of the heating pulses according to this modification. As compared to the heating pulses shown in FIG. 9, the arrangements of blue (B) and black (K) are different. Here, the heating pulses are controlled such that color development is performed in the order of Y→M→C→R.

For example, for color development of red (R) that is a secondary color, the same control as in FIG. 9 is performed because the heating pulse for red (R) is used. For this reason, the color development of red (R) is improved as compared to the conventional method, as described above.

For color development of blue (B) that is a secondary color, the same control as in FIG. 7 of the conventional method is performed because the heating pulse for blue (B) as shown in FIG. 9 is not used. For this reason, the color development of blue (B) is the same as in the conventional method.

For color development of black (K) that is a tertiary color, the heating pulse is controlled to cause cyan (C) and red (R) to develop the colors. In this case, as compared to the conventional method, since the heating pulse for red (R) is used, and the magenta (M) can be developed using the temperature until reaching the temperature for developing yellow (Y), the color development of magenta (M) is improved. In addition, since yellow (Y) can be developed simultaneously in parallel using the time needed to develop magenta (M), the area ratio of the color development of yellow (Y) is improved, and accordingly, the color development efficiency of yellow (Y) is improved. On the other hand, in the method shown in FIG. 11, the color development of black (K) is reduced as compared to the method shown in FIG. 9 in which the heating pulse for black (K) exists.

When the total driving pulse amounts in FIGS. 9 and 11 are compared, the total driving pulse amount in the method shown in FIG. 11 in which four types of heating pulses for Y, M, C, and R are controlled is smaller than in the method shown in FIG. 9 in which six types of heating pulses for Y, M, C, R, B, and K are controlled. For this reason, the processing time needed to print one dot is shorter in the method shown in FIG. 11. More specifically, in the method shown in FIG. 11, image formation of one dot can be performed in a time corresponding to nine sections (p0 to p8), and the time can be shortened by a time corresponding eight sections as compared to FIG. 9.

As described above, when four types of heating pulses for C, M, Y, and R are used in combination, it is possible to improve the color development of red (R) on the image material 10 while suppressing the increase ratio of the total number of driving pulses as compared to the method shown in FIG. 9.

Figure 12:
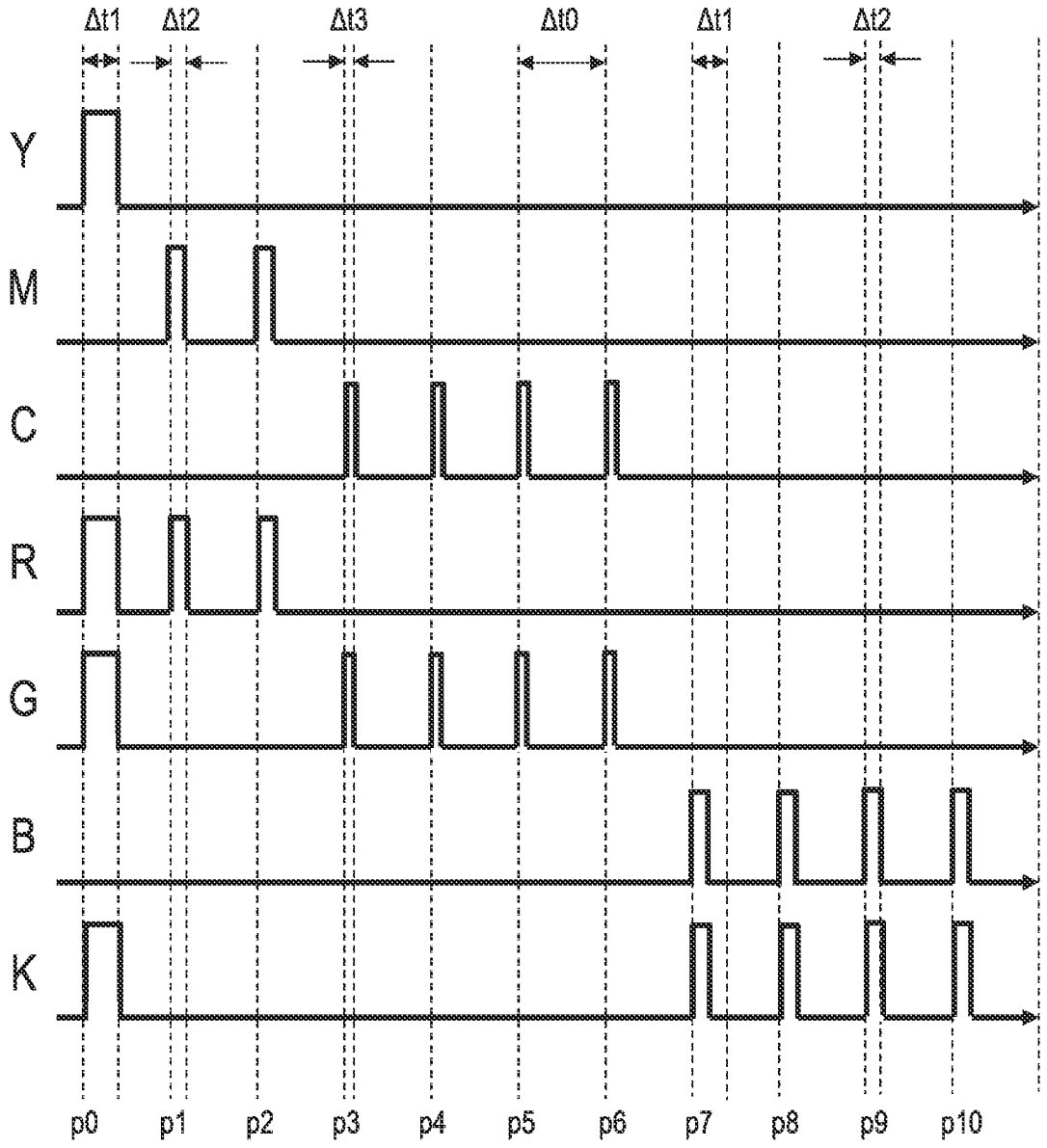
FIG. 12 is a view for explaining the arrangement of heating pulses according to another modification of the first embodiment.

Similarly, it is also possible to improve the color development in the color gamuts of blue (B) and black (K). FIG. 12 shows an example in which the heating pulse for blue (B) is used. Here, the heating pulses are controlled such that color development is performed in the order of Y→M→C→B.

For example, for color development of red (R) that is a secondary color, the same control as in FIG. 7 of the conventional method is performed because the heating pulse for red (R) as shown in FIG. 9 is not used. For this reason, the color development of red (R) is the same as in the conventional method.

For color development of blue (B) that is a secondary color, the same control as in FIG. 9 is performed because the heating pulse for blue (B) is used. For this reason, the color development of blue (B) is improved as compared to the conventional method, as described above.

For color development of black (K) that is a tertiary color, the heating pulse is controlled to cause yellow (Y) and blue (B) to develop the colors. In this case, as compared to the conventional method, since the heating pulse for blue (B) is used, and the cyan (C) can be developed using the temperature until reaching the temperature for developing magenta (M), the color development of cyan (C) is improved. In addition, since magenta (M) can be developed simultaneously in parallel using the time needed to develop cyan (C), the area ratio of the color development of magenta (M) is improved, and accordingly, the color development efficiency of magenta (M) is improved. On the other hand, in the method shown in FIG. 11, the color development of black (K) is reduced as compared to the method shown in FIG. 9 in which the heating pulse for black (K) exists.

When the total driving pulse amounts in FIGS. 9 and 12 are compared, the total driving pulse amount in the method shown in FIG. 12 in which four types of heating pulses for Y, M, C, and B are controlled is smaller than in the method shown in FIG. 9 in which six types of heating pulses for Y, M, C, R, B, and K are controlled. For this reason, the processing time needed to print one dot is shorter in the method shown in FIG. 12. More specifically, in the method shown in FIG. 12, image formation of one dot can be performed in a time corresponding to 11 sections (p0 to p10), and the time can be shortened by a time corresponding six sections as compared to FIG. 9.

Figure 13:
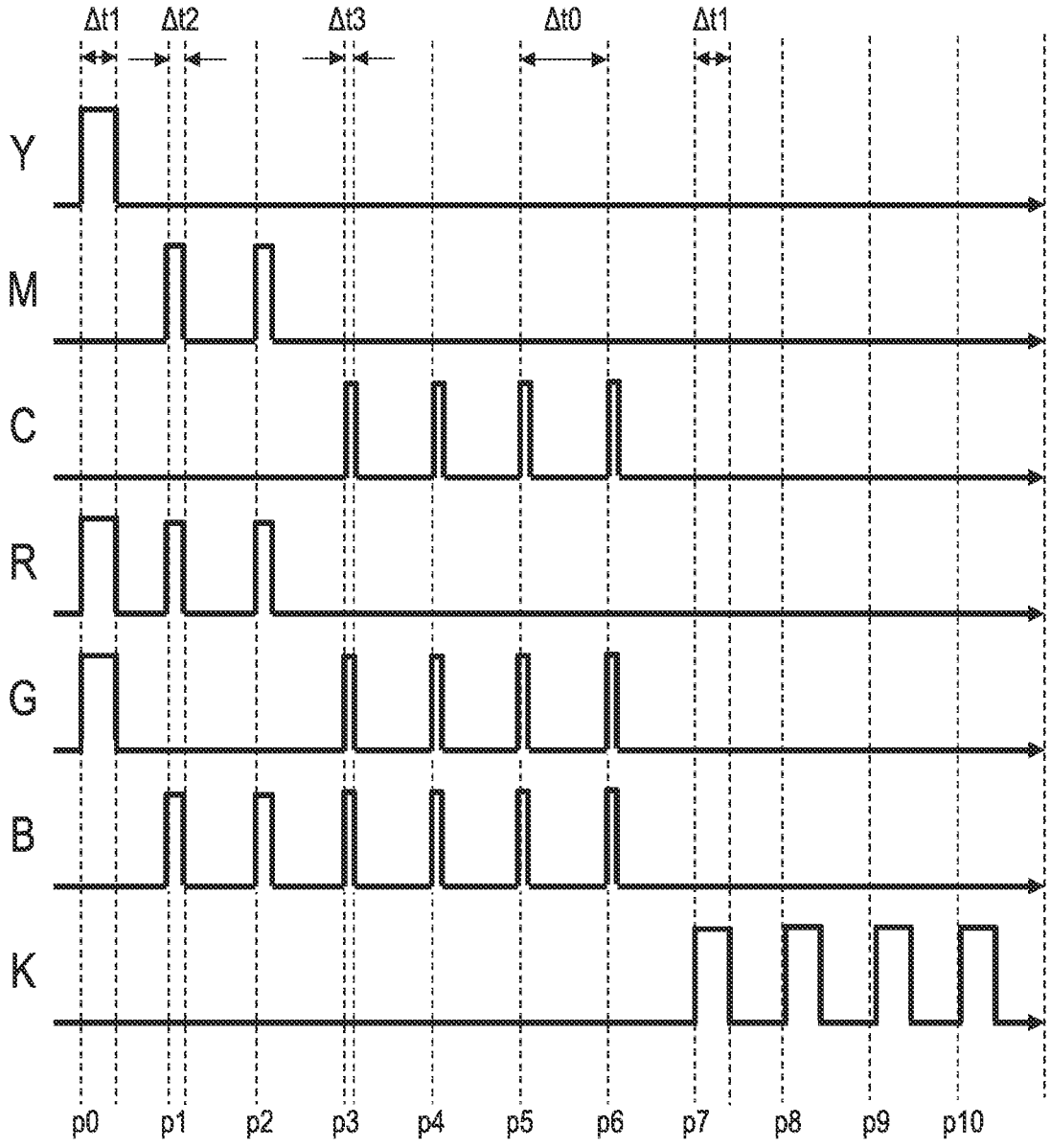
FIG. 13 is a view for explaining the arrangement of heating pulses according to still another modification of the first embodiment.

Similarly, FIG. 13 shows an example in which the heating pulse for black (K) is used. Here, the heating pulses are controlled such that color development is performed in the order of Y→M→C→K.

For example, for color development of red (R) and blue (B) that are secondary colors, the same control as in FIG. 7 of the conventional method is performed because the heating pulse for red (R) and the heating pulse for blue (B) as shown in FIG. 9 are not used. For this reason, the color development of red (R) and blue (B) is the same as in the conventional method.

For color development of black (K) that is a tertiary color, the same control as in FIG. 9 is performed because the heating pulse for black (K) is used. For this reason, the color development of black (K) is improved as compared to the conventional method, as described above.

When the total driving pulse amounts in FIGS. 9 and 13 are compared, the total driving pulse amount in the method shown in FIG. 13 in which four types of heating pulses for Y, M, C, and K are controlled is smaller than in the method shown in FIG. 9 in which six types of heating pulses for Y, M, C, R, B, and K are controlled. For this reason, the processing time needed to print one dot is shorter in the method shown in FIG. 13. More specifically, in the method shown in FIG. 13, image formation of one dot can be performed in a time corresponding to 11 sections (p0 to p10), and the time can be shortened by a time corresponding six sections as compared to FIG. 9.

Furthermore, it is possible to easily imagine that the color development can be improved in two of the three color gamuts of red (R), blue (B), and black (K) described so far. A larger effect can be obtained by selectively using the methods shown in FIGS. 11 to 13, and the two-color gamut improvement (not shown) and the three-color gamut improvement shown in FIG. 9.

More specifically, an arrangement may be used in which in step S1002 of FIG. 10, a composite image is analyzed, and

- the heating pulses shown in FIG. 11 are used for an image in which red is dominant,
- the heating pulses shown in FIG. 12 are used for an image in which blue is dominant,
- the heating pulses shown in FIG. 13 are used for an image in which black is dominant,
- the heating pulses shown in FIG. 9 are used for an image other than the above-described images. When only processing for a color gamut actually necessary for color development on the image material 10 is enhanced, it is possible to suppress the increase ratio of the total number of driving pulses while sufficiently obtaining the effect of color development improvement.

As for the analysis of the image, the analysis may be performed in step S1002 of FIG. 10, as described above. Alternatively, the necessity of heating pulse switching halfway through the image forming operation of a page can be obviated by performing the determination using the image information of the entire print page before the start of printing in step S1001 of FIG. 10.

Additionally, other than the method of automatically performing determination based on an image, the following arrangement in which a specific color gamut is enhanced based on a user instruction may be employed. A description will be made here assuming that the user can select a plurality of image quality modes in image formation. Examples of the image quality modes are a "hot" mode in which image formation is performed while enhancing red (R), a "cool" mode in which image formation is performed while enhancing blue (B), a "night" mode in which image formation is performed while enhancing black (K), and a "standard" mode that places importance on the balance. The heating pulses are switched in accordance with user selection in the following way.

The heating pulses shown in FIG. 11 are used when the "hot" mode is selected.

The heating pulses shown in FIG. 12 are used when the "cool" mode is selected.

The heating pulses shown in FIG. 13 are used when the "night" mode is selected.

The heating pulses shown in FIG. 9 are used when the "standard" mode is selected.

In addition, the necessity of settings for each print job by the user may be obviated by an arrangement in which the image quality mode is not selected by the user as needed but registered in advance on the side of the image forming apparatus 40. At this time, the user may be allowed to visually recognize the setting of the print mode by the shape or color of the exterior of the UI (User Interface) of the image forming apparatus 40.

Second Embodiment

In the first embodiment, an example in which the color development on the image material 10 is improved by using dedicated heating pulses for red (R) and blue (B) that are secondary colors and black (K) that is a tertiary color has been described. In the second embodiment according to the present invention, an example in which the color development on an image material 10 is improved while further decreasing the total number of driving pulses as compared to before will be described.

[Heating Pulses]

Figure 14:
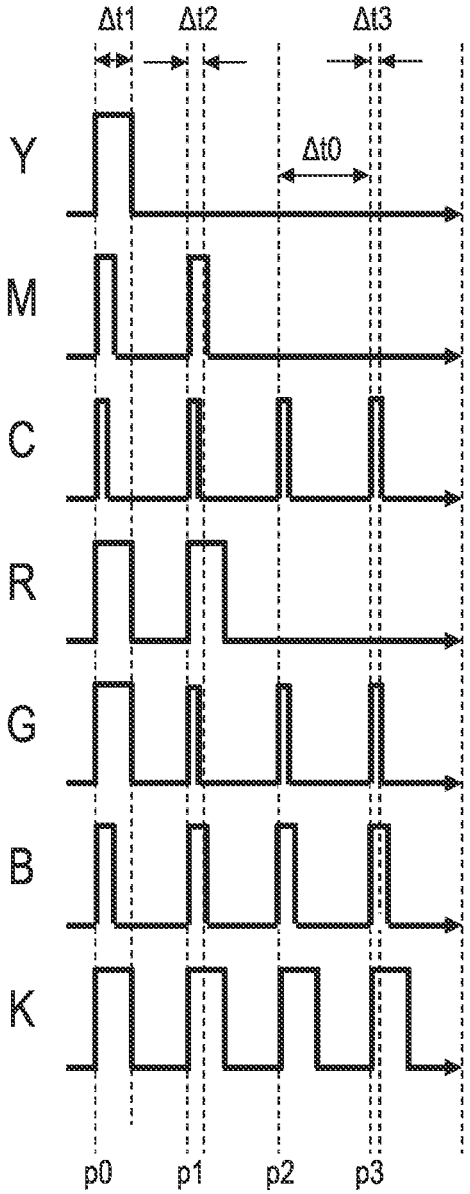
FIG. 14 is a view for explaining the arrangement of heating pulses according to the second embodiment.

FIG. 14 is a view for explaining an example of heating pulses according to the second embodiment. In FIG. 14, control is performed such that the heating pulses for C, M, Y, R, B, and K shown in FIG. 9 are superimposed. Here, "superimpose" means deciding the pulse widths of heating pulses and the number of pulses by calculating the logical OR of pulses corresponding to the color components when causing a plurality of image materials (image forming layers) to develop the colors to reproduce the second color or tertiary color. That is, the start positions of pulses for the color components, which are included in the heating pulses for the colors, are set to p0. That is, the rise positions of the first pulses for the color components match at p0.

In this method, image formation of one pixel is performed in a time corresponding to four sections (p0 to p3). The ratio of the number of pulses used for the color development of yellow (Y) to the total number of pulses is one pulse in the total of four pulses. In the method shown in FIG. 9, the ratio of the number of pulses used for the color development of yellow (Y) to the total number of pulses is one pulse in the total of 17 pulses. In the method shown in FIG. 14, the area ratio of yellow (Y) is improved, and accordingly, the color development efficiency of yellow (Y) is improved. For each of M, Y, R, B, and K as well, the ratio to the total number of pulses is improved, and the area ratio is improved. Hence, the color development efficiency of each color is improved.

Additionally, by the control of superimposing the pulses, the total number of driving pulses necessary for generating one dot is decreased from a number corresponding to seven section to a number corresponding to four sections, as compared to FIG. 7 of the conventional method, or is decreased from a number corresponding to 17 sections to a number corresponding to four sections, as compared to FIG. 9. As a result, the processing time needed for printing can be shortened.

[Processing Procedure]

Figure 15:
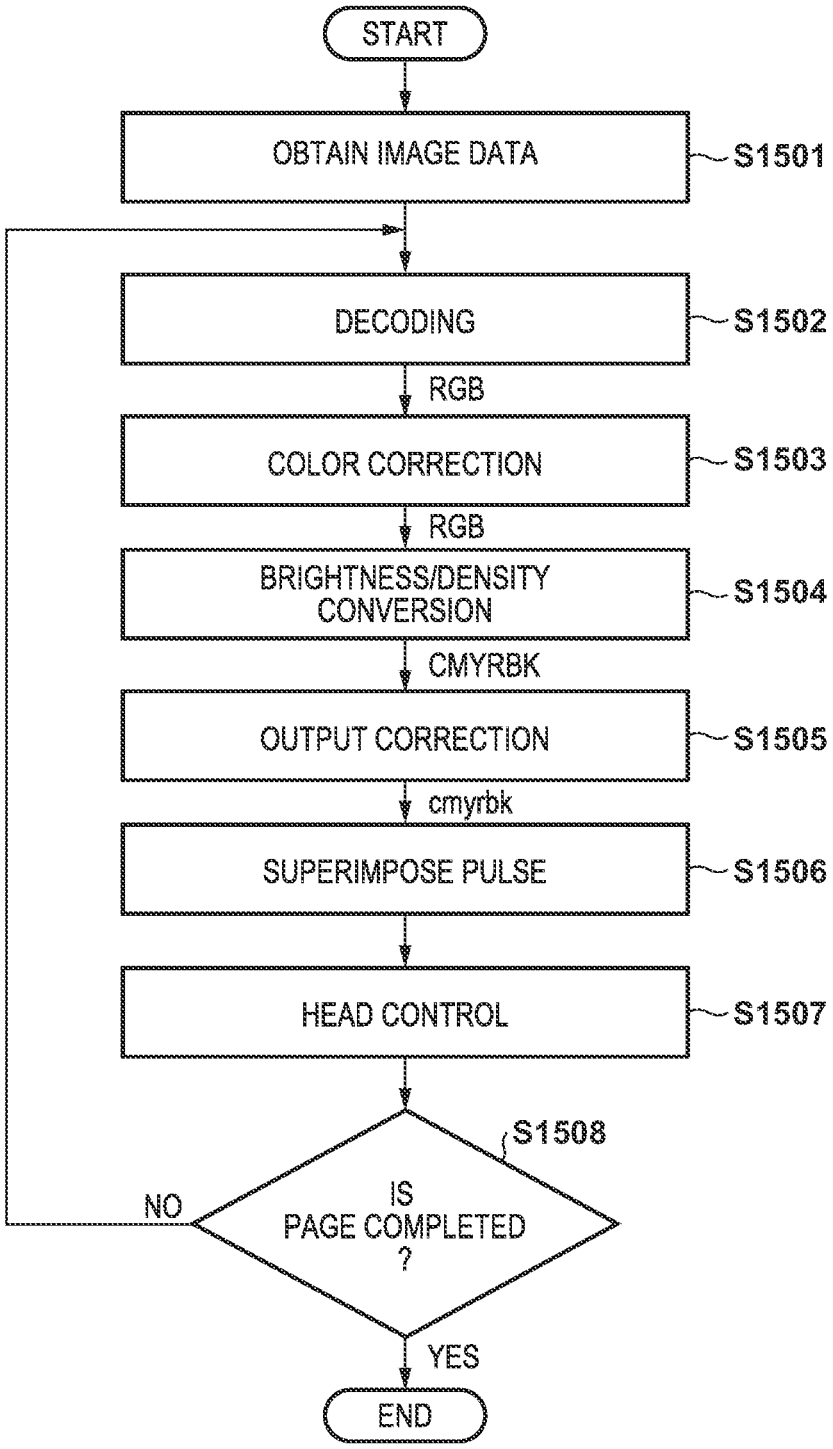
FIG. 15 is a flowchart of processing at the time of image formation according to the second embodiment.

FIG. 15 is a flowchart of image processing for implementing the heating pulses according to this embodiment. The procedure shown in FIG. 15 is executed in the processing of step S615 shown in FIG. 6. This procedure is implemented when, for example, a CPU 401 of an image forming apparatus 40 reads out programs and data included in a ROM 403 or the like and executes them. Note that this processing may partially be executed by an image processing accelerator 406. Steps S1501 to S1505 are the same as steps S1001 to S1005 of FIG. 10 described in the first embodiment, and a description thereof will be omitted here.

In step S1506, the CPU 401 superimposes the pulses corresponding to the colors. More specifically, the pulses are superimposed by P0=max(y, m, c, r, b, k)

P1=max(m, c, r, b, k)

P2=max(c, b, k)

P3=max(c, b, k)

where the function max(x, y) means selecting the maximum pulse width of pulse widths x and y.

Note that when implementing this processing by an electric circuit, this may be implemented by the logical OR of P0=y+m+c+r+b+k P1=m+c+r+b+k P2=c+b+k P3=c+b+k where y, m, c, r, b, and k are the control pulses of the above-described colors. A symbol "+" represents the logical OR. As shown in FIG. 14, the start points (rise timings) of the pulses corresponding to the colors match.

In step S1507, the CPU 401 controls a printhead 30 via a head controller 405. A desired color is formed on the image material 10 by controlling the pulses in p0/p1/p2/p3 shown in FIG. 14.

In step S1508, the CPU 401 determines whether the printing of the page is completed. If the printing is completed (YES in step S1508), the processing procedure is ended, and the process advances to processing of the next page or the processing of step S616 of FIG. 6. If the printing is not completed (NO in step S1508), the process returns to step S1502 to continue the image formation processing for the page.

As described above, using FIG. 14 as an example, of the four pulses in p0 to p3, pulses usable for the color development of red (R) are two pulses in p0 and p1. For blue (B), four pulses in p0 to p3 can be used, and for black (K), four pulses in p0 to p3 can be used. Since this enables efficient color development as compared to the conventional arrangement, the area ratio of the color development on the image material 10 is improved. Accordingly, the color development efficiency of each color is improved.

Additionally, as described above, since the total number of driving pulses necessary for creating one dot is decreased, the processing time needed for printing can be shortened.

Modification 1 of Second Embodiment

In the above-described second embodiment, an example in which the area ratio of color development on the image material 10 is increased by superimposing the heating pulses, thereby improving the color development efficiency in addition to the arrangement of the first embodiment has been described. In this modification, an example in which the end positions of the heating pulses are made to match from the viewpoint of color misalignment will further be described.

Figure 16:
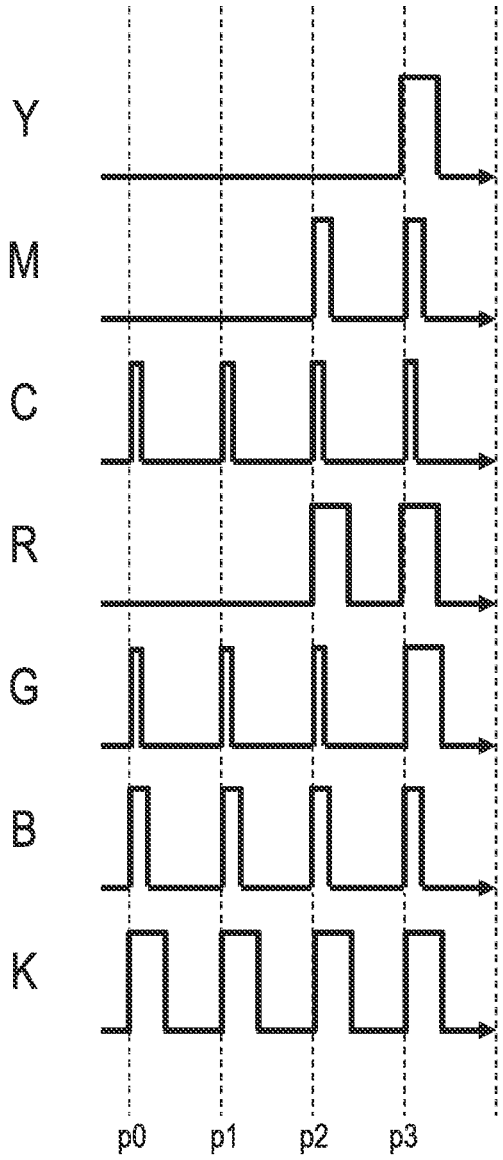
FIG. 16 is a view for explaining the arrangement of heating pulses according to Modification 1 of the second embodiment.

FIG. 16 is a view for explaining an example of heating pulses according to this modification. Like FIG. 14, control is performed such that C, M, Y, R, B, and K are superimposed. However, unlike FIG. 14, the position where the pulses are superimposed is not the pulse start position p0 but the pulse end position p3.

When superimposing the pulses at the start, as shown in FIG. 14, the timings of color development are shifted for yellow (Y), magenta (M), and cyan (C) which are primary colors. For this reason, the dots of the colors may not be superimposed, and color misalignment may occur. That is, for the primary colors, color development is performed at a timing on the periphery of the final pulse in the heating pulses for causing color development. Hence, if the arrangement (number) of heating pulses is different, the color development timing changes.

The position at which the pulses are superimposed is set not to the pulse start position p0 but to the pulse end position p3, thereby reducing the occurrence of color misalignment. In the case of the heating pulses shown in FIG. 14, the timing of color development of yellow (Y) is p0. The timing of color development of magenta (M) is p1. The timing of color development of cyan (C) is p3. Hence, a time difference of about Δt0 (=p1−p0) is generated between the timing of color development of yellow (Y) and the timing of color development of magenta (M). In addition, a time difference of about Δt0×3(=p3−p0) is generated between the timing of color development of yellow (Y) and the timing of color development of cyan (C). A time difference of about Δt0×2 (=p3−p1) is generated between the timing of color development of magenta (M) and the timing of color development of cyan (C).

On the other hand, in the case of the heating pulses shown in FIG. 16, the timing of color development of yellow (Y) is p3. The timing of color development of magenta (M) is p3. The timing of color development of cyan (C) is p3. Hence, the timings of color development of yellow (Y), magenta (M), and cyan (C) are the same or almost the same, and the time difference concerning the color development timing is eliminated or becomes small.

The time differences shown in FIGS. 14 and 16 are compared. The time differences are smaller in FIG. 16 by Δt0−0=Δt0 for yellow (Y) and magenta (M), by t0×3−0=Δt0×3 for yellow (Y) and cyan (C), and by Δt0×2−0=Δt0×2 for magenta (M) and cyan (C).

In the above-described way, the position at which the pulses are superimposed is set not to the pulse start position p0 but to the pulse end position p3, thereby making the timings to perform color development match. When the timings to perform color development match, color misalignment hardly occurs. This provides a large effect of suppressing color misalignment in a case in which image formation and conveyance of the image material 10 are performed simultaneously in parallel, or in a case in which the conveyance speed is higher than the speed of image formation.

Modification 2 of Second Embodiment

In Modification 1 of the second embodiment, an example in which the end positions of the heating pulses are made to match from the viewpoint of color misalignment has been described. On the other hand, in this modification, an example in which the center positions of the heating pulses (the rise positions of the pulses at the center) are made to match from the viewpoint of both the color development efficiency and the color misalignment will be described.

Figure 17:
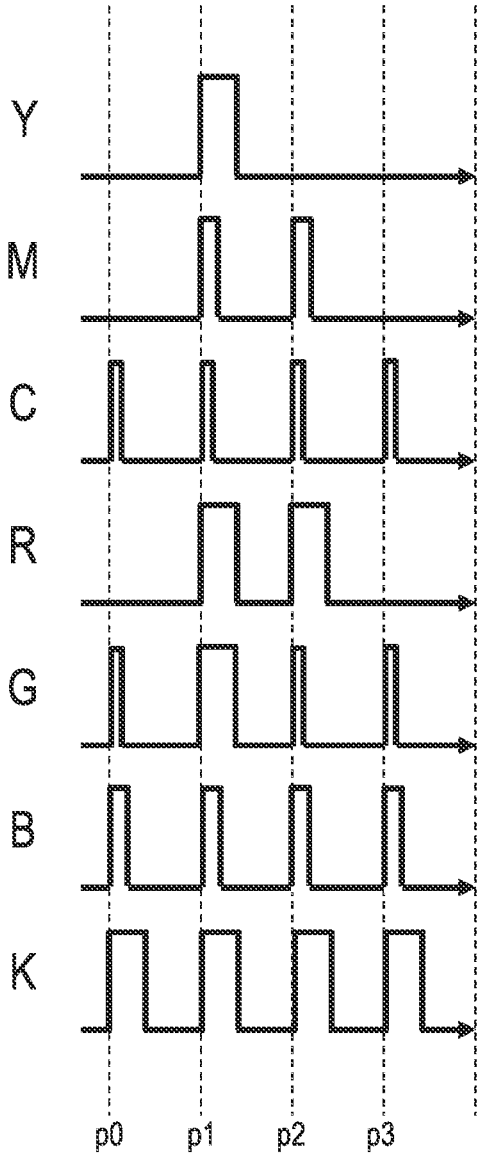
FIG. 17 is a view for explaining the arrangement of heating pulses according to Modification 2 of the second embodiment.

FIG. 17 is a view for explaining an example of heating pulses according to this modification. Like FIG. 14, control is performed such that C, M, Y, R, B, and K are superimposed. However, unlike FIG. 14, the position where the pulses are superimposed is not the pulse start position p0 but the pulse center position p1.

When superimposing the pulses at the start, as shown in FIG. 14, the timings of color development are shifted for yellow (Y), magenta (M), and cyan (C) which are primary colors. For this reason, color misalignment may occur, with the dots of the colors not being superimposed. On the other hand, when superimposing the pulses at the end, as shown in FIG. 16, the timings of color development are the same for the primary colors. However, since the color development is performed only in one pulse of four pulses, the overall surface coverage may lower, and the color development efficiency may degrade.

Hence, the position at which the pulses are superimposed is set to neither the pulse start position p0 nor the end position p3 but the center position, thereby ensuring the overall surface coverage while improving the timing to perform the color development. Note that p1 will be exemplified here as the center position at which the pulses are superimposed. However, the center position to be used may vary depending on the number of pulses in the heating pulses or the arrangements of pulses corresponding to the colors.

In the case of the heating pulses shown in FIG. 14, the timing of color development of yellow (Y) is p0. The timing of color development of magenta (M) is p1. The timing of color development of cyan (C) is p3. Hence, a time difference of about Δt0(=p1−p0) is generated between the timing of color development of yellow (Y) and the timing of color development of magenta (M). In addition, a time difference of about Δt0×3 (=p3−p0) is generated between the timing of color development of yellow (Y) and the timing of color development of cyan (C). A time difference of about Δt0×2 (=p3−p1) is generated between the timing of color development of magenta (M) and the timing of color development of cyan (C).

On the other hand, in the case of the heating pulses shown in FIG. 17, the timing of color development of yellow (Y) is p1. The timing of color development of magenta (M) is p2. The timing of color development of cyan (C) is p3. Hence, a time difference of about Δt0(=p2−p1) is generated between the timing of color development of yellow (Y) and the timing of color development of magenta (M). In addition, a time difference of about Δt0×2(=p3−p1) is generated between the timing of color development of yellow (Y) and the timing of color development of cyan (C). Furthermore, a time difference of about Δt0(=p3−p2) is generated between the timing of color development of magenta (M) and the timing of color development of cyan (C).

The time differences shown in FIGS. 14 and 17 are compared. The time differences relating to timings of color development are smaller in FIG. 17 by Δt0−Δt0=0 for yellow (Y) and magenta (M), by Δt0×3−Δt0×2=Δt0 for yellow (Y) and cyan (C), and by Δt0×2−Δt0=Δt0 for magenta (M) and cyan (C).

Additionally, in the method shown in FIG. 16, since yellow (Y) develops the color in p1, magenta (M) and red (R) develop the colors in p2, and cyan (C), blue (B), and black (K) develop the colors in p3, color development is performed in three pulses of four pulses. Since the number of times of color development is larger than in the color development only in one pulse of four pulses in the method shown in FIG. 17, the overall surface coverage rises in the method of FIG. 16 as compared to FIG. 17.

As described above, when the pulses are superimposed while making the center positions of heating pulses match, the color development can be controlled in consideration of both the color development efficiency and the color misalignment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-112219, filed Jun. 12, 2018, which is hereby incorporated by reference herein in its entirety.

What is claimed is:

1. An image forming apparatus comprising:

a printhead configured to add energy to an image material including a plurality of color development layers that have different color development characteristics and develop colors in response to heat, the plurality of color development layers including a first color development layer and a second color development layer that are formed by layering the first color development layer and the second development layer in that order as viewed from a side of the printhead; and a control unit configured to output, based on image data, signal patterns for controlling the energy to be added to the image material by the printhead, the signal patterns including (i) signal patterns for developing respective color development layers of the plurality of color development layers and (ii) a signal pattern for developing colors reproduced by developing color development layers that are not colors reproduced by developing all of the color development layers.

2. The apparatus according to claim 1, wherein the plurality of color development layers is formed by layering the first color development layer, the second color development layer, and a third color development layer in that order as viewed from the side of the printhead, and the signal patterns include a first signal pattern for developing a color reproduced by developing the first color development layer and the second color development layer, and a second signal pattern for developing a color reproduced by developing the first color development layer and the third development layer.

3. The apparatus according to claim 1, wherein the signal the signal patterns include a signal pattern for developing a color that is reproduced by causing all color development layers to develop their colors, said signal pattern being configured to add sufficient energy to cause all of the plurality of color development layers to develop their colors.

4. The apparatus according to claim 1, wherein each of the signal patterns defines a heating time and a heating temperature for the image material by a pulse width and the number of pulses.

5. The apparatus according to claim 1, wherein the plurality of color development layers include color development layers corresponding to yellow, cyan, and magenta.

6. The apparatus according to claim 5, wherein the plurality of color development layers are formed by layering yellow, magenta, and cyan in that order as viewed from the side of the printhead.

7. The apparatus according to claim 5, wherein the plurality of color development layers are formed by layering cyan, magenta, and yellow in that order as viewed from the side of the printhead.

8. The apparatus according to claim 5, wherein the control unit converts the image data into data expressed by cyan, the image data expressed by magenta, the image data expressed by yellow, the image data expressed by black, and the image data expressed by at least one color that is different from cyan, magenta, yellow and black, by using a plurality of conversion tables corresponding to respective colors, wherein the signal patterns correspond to the respective colors, wherein the signal pattern corresponding to cyan is a pattern for developing the color development layer corresponding to cyan, wherein the signal pattern corresponding to magenta is a pattern for developing the color development layer corresponding to magenta, wherein the signal pattern corresponding to yellow is a pattern for developing the color development layer corresponding to yellow, wherein the signal pattern corresponding to black is a pattern for developing all of the color development layers, and wherein the signal pattern corresponding to the at least one color is a pattern for developing two color development layers of all of the color development layers.

9. The apparatus according to claim 8, wherein the at least one color is red, green, or blue.

10. The apparatus according to claim 1, wherein the control unit outputs the plurality of signal patterns for developing the plurality of colors reproduced by developing the plurality of color development layers by making ON timings of first signals match.

11. The apparatus according to claim 1, wherein the control unit outputs the plurality of signal patterns for developing the plurality of colors reproduced by developing the plurality of color development layers by making ON timings of final signals match.

12. The apparatus according to claim 1, wherein the control unit outputs the plurality of signal patterns for developing the plurality of colors reproduced by developing the plurality of color development layers such that ON timings of signals at center positions match.

13. The apparatus according to claim 1, further comprising:

a detection unit configured to detect a temperature of the image material; and a setting unit configured to set a predetermined threshold based on the image data, wherein the control unit causes the image formation by the printhead to wait in a case in which it is determined that the temperature detected by the detection unit exceeds the predetermined threshold.

14. The apparatus according to claim 13, wherein the setting unit sets the predetermined threshold based on a frequency of a signal pattern used to develop a color designated in the image data.

15. The apparatus according to claim 1, further comprising a relative movement unit configured to perform relatively movement between the image material and the printhead, wherein the control unit outputs the signal patterns for developing colors reproduced by developing the plurality of color development layers and the signal pattern for developing a color reproduced by developing the plurality of color development layers according to the relative movement.

16. The apparatus according to claim 1, wherein the print head adds energy to the image material by heating the image material.

17. The apparatus according to claim 1, wherein the control unit outputs a signal pattern for developing a color of each of the plurality of color development layers, based on data, out of the image data, corresponding to a color reproduced by developing each of the plurality of color development layers, and the control unit outputs a signal pattern for developing a color, reproduced by developing two or more color development layers of the plurality of color development layers, that is not a color reproduced by developing all of the plurality of color development layers, based on data, out of the image data, corresponding to the color reproduced by developing two or more color development layers of the plurality of color development layers, that is not a color reproduced by developing all of the plurality of color development layers.

18. The apparatus according to claim 17, wherein the control unit controls a pulse width of the outputted signal pattern, based on tonality represented by the image data.

19. An image forming apparatus comprising:

a printhead configured to add the energy to an image material including N color development layers that have different color development characteristics and develop colors in accordance with added energy; and a control unit configured to convert pixel values of image data into M values corresponding to a color that can be reproduced by causing one or a plurality color development layers of the N color development layers to develop colors, M being greater than N, and (ii) output signal patterns for controlling the energy to be added to the image material by the printhead, the signal patterns include (i) a signal pattern that has a pulse width and the number of pulses corresponding to the converted value and that is used to control the energy to be added to the image material by the printhead, (ii) signal patterns for developing respective color development layers, and (iii) a signal pattern for developing colors reproduced by developing color development layers that are not colors reproduced by developing all of the color development layers.

20. An image forming apparatus comprising:

a printhead configured to add energy to an image material including a plurality of color development layers that have different color development characteristics and develop colors in response to heat;

a control unit configured to output, based on image data, a signal pattern used to control the energy to be added to the image material by the printhead;

a detection unit configured to detect a temperature of the image material; and a setting unit configured to set a predetermined threshold based on the image data, wherein the control unit causes the image formation by the printhead to wait in a case in which it is determined that the temperature detected by the detection unit exceeds the predetermined threshold.

21. The apparatus according to claim 20, wherein the setting unit sets the predetermined threshold based on a frequency of a signal pattern used to develop a color designated in the image data.

22. The apparatus according to claim 20, wherein the predetermined threshold set by the setting unit when a number of dots of yellow and magenta printed based on the image data is a first number of dots is larger than that when the number of dots of yellow and magenta printed based on the image data is a second number of dots larger than the first number of dots.

23. The apparatus according to claim 20, wherein the predetermined threshold set by the setting unit when the image formed by the image data is a color image formed by a color other than either of single yellow and single magenta is larger than that when the image formed by the image data is an image formed only by at least one of single yellow and single magenta.

24. A method controlling of an image forming apparatus, the method comprising:

outputting, based on image data, signal patterns for controlling energy to be added to an image material by a printhead for adding the energy to the image material including a plurality of color development layers that have different color development characteristics and develop colors in accordance with added energy, color development layers to develop colors the plurality of color development layers including a first color development layer and a second color development layer that are formed by layering the first color development layer and the second development layer in that order as viewed from a side of the printhead, the signal patterns including (i) signal patterns for developing respective color development layers of the plurality of color development layers and (ii) a signal pattern for developing colors reproduced by developing color development layers that are not colors reproduced by developing all of the color development layers.

25. An image forming apparatus comprising:

a printhead configured to add energy to an image material including a plurality of color development layers that have different color development characteristics and develop colors in response to heat, the plurality of color development layers including a first color development layer and a second color development layer that are formed by layering the first color development layer and the second development layer in that order as viewed from a side of the printhead;

a detection unit configured to detect a temperature of the image material;

a setting unit configured to set a predetermined threshold based on the image data; and a control unit configured to output, based on image data, signal patterns for controlling the energy to be added to the image material by the printhead, the signal patterns including (i) signal patterns for developing respective color development layers of the plurality of color development layers and (ii) a signal pattern for developing colors reproduced by developing color development layers that are not colors reproduced by developing all of the color development layers, the control unit causing the image formation by the printhead to wait in a case in which it is determined that the temperature detected by the detection unit exceeds the predetermined threshold, wherein the setting unit sets the predetermined threshold based on a frequency of a signal pattern used to develop a color designated in the image data.

* * * * *